US009298157B2

(12) United States Patent
Sakuma

(10) Patent No.: US 9,298,157 B2
(45) Date of Patent: Mar. 29, 2016

(54) CARTRIDGE HAVING A PLURALITY OF FRAMES AND IMAGE FORMING APPARATUS PROVIDED WITH THE CARTRIDGE

(71) Applicant: Brother Kogyo Kabushiki Kaisha, Nagoya-shi, Aichi-ken (JP)

(72) Inventor: Susumu Sakuma, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/593,675

(22) Filed: Jan. 9, 2015

(65) Prior Publication Data

US 2015/0125179 A1 May 7, 2015

Related U.S. Application Data

(63) Continuation-in-part of application No. PCT/JP2012/080833, filed on Nov. 29, 2012.

(30) Foreign Application Priority Data

Jul. 9, 2012 (JP) ..... 2012-154142

(51) Int. Cl.
*G03G 21/18* (2006.01)

(52) U.S. Cl.
CPC ..... *G03G 21/1803* (2013.01); *G03G 21/1814* (2013.01)

(58) Field of Classification Search
CPC ..... G03G 21/1803; G03G 21/1814
See application file for complete search history.

(56) References Cited

U.S. PATENT DOCUMENTS 5,329,299 A * 7/1994 Odagiri et al. ..... 347/256
5,371,575 A 12/1994 Sekino et al.
5,606,406 A * 2/1997 Ikeyama et al. ..... 399/111
6,006,060 A * 12/1999 Sato ..... 399/284

(Continued)

FOREIGN PATENT DOCUMENTS

JP H04-220658 A 8/1992
JP H05-35005 A 2/1993

(Continued)

OTHER PUBLICATIONS

Jan. 22, 2015—(PCT) International Preliminary Report on Patentability—App PCT/JP2012/080833.
Dec. 8, 2015—(JP) Office Action—App 2012-154142.

*Primary Examiner* — G. M. Hyder
(74) *Attorney, Agent, or Firm* — Banner & Witcoff, Ltd.

(57) ABSTRACT

A cartridge includes a first frame, an image-carrying member, a transfer member, and a second frame. The image-carrying member is rotatably supported by the first frame and is configured to carry a developer image thereon. The transfer member is rotatably supported by the first frame and faces the image-carrying member. The transfer member is configured to transfer the developer image from the image-carrying member to a recording medium. The image-carrying member and the transfer member define a nip portion therebetween. The second frame is attached to the first frame and is disposed downstream from the nip portion in a passage direction in which a recording medium passes. The second frame defines at least part of a first opening. The first opening allows a recording medium that has passed through the nip portion to pass therethrough.

15 Claims, 10 Drawing Sheets

(56) References Cited

U.S. PATENT DOCUMENTS

| | | | | |
|---|---|---|---|---|
| 6,330,410 | B1 * | 12/2001 | Okabe et al. | 399/113 |
| 2005/0169669 | A1 | 8/2005 | Nishimura et al. | |
| 2006/0245786 | A1 | 11/2006 | Suzuki | |

FOREIGN PATENT DOCUMENTS

| | | | |
|---|---|---|---|
| JP | H06-60858 | U | 8/1994 |
| JP | 2005-215547 | A | 8/2005 |
| JP | 2006-308802 | A | 11/2006 |

* cited by examiner

CARTRIDGE HAVING A PLURALITY OF FRAMES AND IMAGE FORMING APPARATUS PROVIDED WITH THE CARTRIDGE

CROSS REFERENCE TO RELATED APPLICATION

This application claims priority from Japanese Patent Application No. 2012-154142 filed Jul. 9, 2012. This application is also a continuation-in-part of International Application No. PCT/JP2012/080833 filed Nov. 29, 2012 in Japan Patent Office as a Receiving Office. The entire contents of both applications are incorporated herein by reference.

TECHNICAL FIELD

The present invention relates to a cartridge that is mounted in an image forming apparatus employing an electrophotographic system and to the image forming apparatus in which this cartridge is mounted.

BACKGROUND

As a cartridge mounted in an image formatting apparatus that adopts an electrophotographic system, there is known a photoreceptor cartridge which includes a photosensitive member and on which a developer cartridge accommodating developer therein can be detachably mounted.

As such a photoreceptor cartridge, for example, the following drum cartridge is proposed. The proposed drum cartridge includes: a lower housing on which a photosensitive drum and a transfer roller are mounted; and an upper housing on which a scorotron charger and a cleaning member are mounted. The upper housing is mounted on the lower housing so as to cover from above (see US 2006/245786A1, for example).

SUMMARY

In the drum cartridge described in US 2006/245786A1, a sheet passes between the photosensitive drum and the transfer roller, passes between the lower rear wall (reference symbol 87) and the rear bottom wall (reference symbol 85) supporting the transfer roller, and is conveyed toward the fixing unit.

In the above-described drum cartridge, vibration generated by the driving of the transfer roller may be transmitted to the rear bottom wall, and the sheet that has passed between the photosensitive drum and the transfer roller may hit the rear bottom wall.

If the sheet hits the rear bottom wall, a toner image that has been transferred to the sheet could be distorted, possibly leading to a decrease or drop in image quality.

In view of the foregoing, it is an object of the present invention to provide a cartridge that can prevent a decrease in image quality, and an image forming apparatus on which this cartridge is mounted.

In order to attain the above and other objects, there is provided a cartridge that may include a first frame, an image-carrying member, a transfer member, and a second frame. The image-carrying member may be rotatably supported by the first frame and configured to carry a developer image thereon. The transfer member may be rotatably supported by the first frame and may face the image-carrying member. The transfer member may be configured to transfer the developer image from the image-carrying member to a recording medium. The image-carrying member and the transfer member may define a nip portion therebetween. The second frame may be attached to the first frame and disposed downstream from the nip portion in a passage direction in which a recording medium passes. The second frame may define at least part of a first opening. The first opening may allow a recording medium that has passed through the nip portion to pass therethrough.

According to another aspect, the present invention provides an image forming apparatus that may include a cartridge, a main body, and a fixing device. The cartridge may include a first frame, an image-carrying member, a transfer member, and a second frame. The image-carrying member may be rotatably supported by the first frame and configured to carry a developer image thereon. The transfer member may be rotatably supported by the first frame and may face the image-carrying member. The transfer member may be configured to transfer the developer image from the image-carrying member to a recording medium. The image-carrying member and the transfer member may define a nip portion therebetween. The second frame may be attached to the first frame and disposed downstream from the nip portion in a passage direction in which a recording medium passes. The second frame may define at least part of a first opening. The first opening may allow a recording medium that has passed through the nip portion to pass therethrough. The cartridge may be mounted on the main body. The fixing device may be disposed within the main body and may oppose the first opening. The fixing device may be configured to thermally fix the developer image onto a recording medium that has been passed through the first opening.

DETAILED DESCRIPTION

1. Printer

Figure 1:
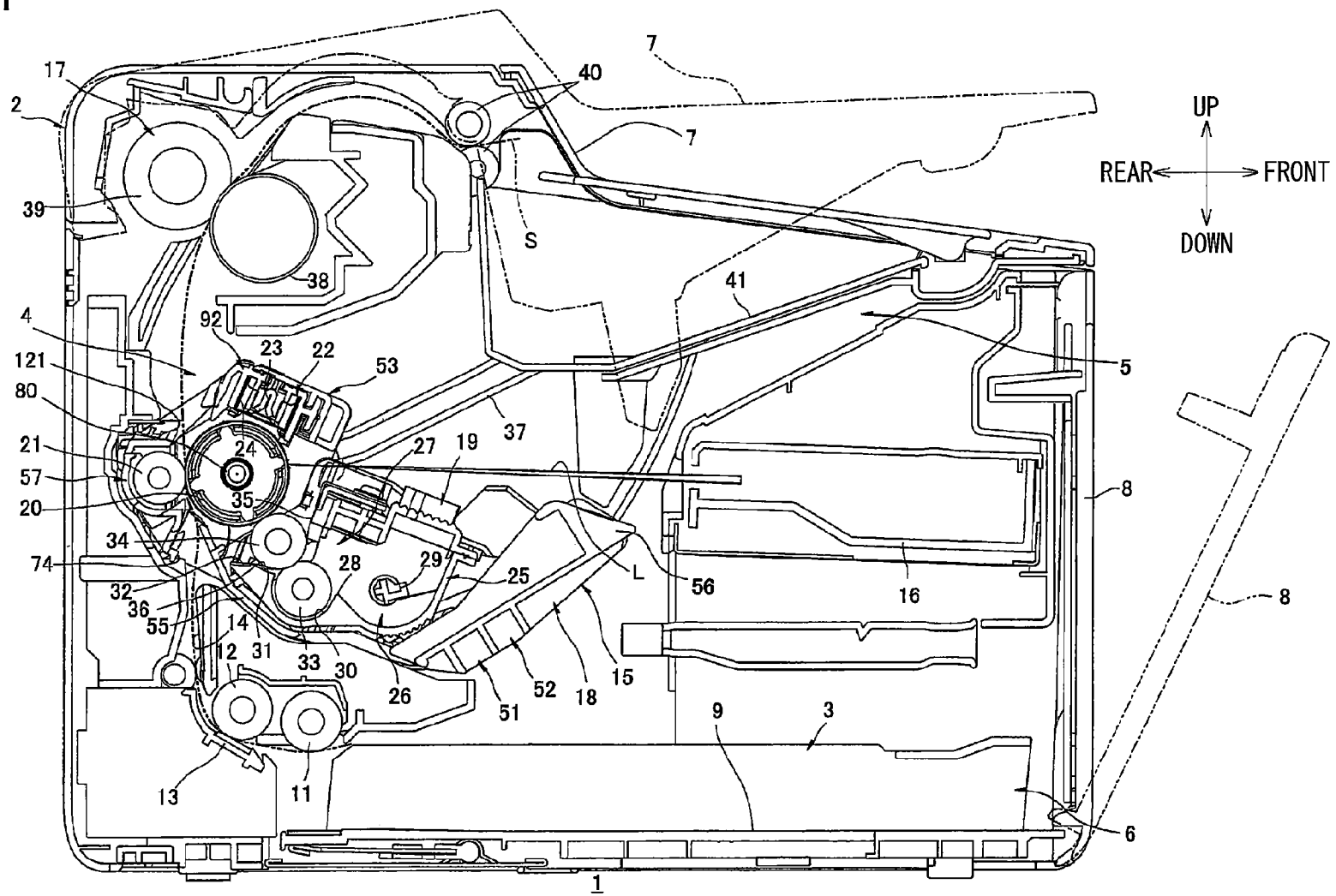
FIG. 1 is a central cross-sectional view of a printer as an image forming apparatus according to an embodiment of the present invention.

FIG. 1 shows a printer 1 serving as an example of an image forming apparatus according to an embodiment of the present invention. The printer 1 is provided with a main casing 2 having a box-like shape and serving as an example of a main body for the printer 1.

Within the main casing 2, the printer 1 is also provided with a sheet-feeding unit 3 for feeding sheets S of paper, and an image-forming unit 4 for forming images on the sheets S supplied by the sheet-feeding unit 3. The sheet S of paper serves as an example of a recording medium.

Directions related to the printer 1 and to a process cartridge 15 (described later) will be specified based on orientations of these devices when resting on a level surface, and specifically will refer to the directions indicated by arrows in the drawings.

(1) Main Casing

Formed in the main casing 2 are a cartridge access opening 5 for mounting and removing the process cartridge 15 (described later), and a paper-introducing opening 6 through which the sheets S of paper are inserted into the main casing 2.

The cartridge access opening 5 is formed in an upper end portion of the main casing 2, penetrating the main casing 2 vertically.

The paper-introducing opening 6 is formed in a bottom portion on a front end portion of the main casing 2 and penetrates the front end portion in a front-rear direction.

The main casing 2 also includes a top cover 7 disposed on the upper end portion thereof, and a sheet-feeding cover 8 disposed on the front end portion thereof.

The top cover 7 is disposed so as to be capable of pivoting (moving) about its rear edge portion between a closed position for covering the cartridge access opening 5, and an open position for exposing the cartridge access opening 5 (see phantom lines in FIG. 1).

The sheet-feeding cover 8 is disposed so as to be capable of pivoting (moving) about its bottom edge portion between a first position for covering the paper-introducing opening 6, and a second position for exposing the paper-introducing opening 6.

The main casing 2 further includes biasing members 131 (FIG. 2) made of metal.

(2) Sheet-Feeding Unit

The sheet-feeding unit 3 includes a sheet-supporting part 9 provided in a lower portion of the main casing 2.

The sheet-supporting part 9 is in communication with the exterior of the main casing 2 through the paper-introducing opening 6.

The sheets S of paper are placed in the sheet-feeding unit 3 when the sheet-feeding cover 8 is in its second position. More specifically, the sheets S are inserted through the paper-introducing opening 6 such that rear portions of the sheets S are stacked in the sheet-supporting part 9 and front portions of the sheets S are stacked on a top surface of the sheet-feeding cover 8.

The sheet-feeding unit 3 further includes a pickup roller 11 disposed above a rear edge portion of the sheet-supporting part 9, a feeding roller 12 disposed rearward of the pickup roller 11, a feeding pad 13 arranged to confront the lower rear side of the feeding roller 12, and a feeding path 14 extending continuously upward from a rear edge of the feeding pad 13.

(3) Image-Forming Unit

The image-forming unit 4 includes the process cartridge 15, a scanning unit 16, and a fixing unit 17 as an example of a fixing device.

(3-1) Process Cartridge

The process cartridge 15 can be mounted in and removed from the main casing 2. When mounted in the main casing 2, the process cartridge 15 is arranged above a rear portion of the sheet-feeding unit 3.

The process cartridge 15 includes a drum cartridge 18 and the developing cartridge 19 as an example of a developing unit. The drum cartridge 18 is detachably mountable in the main casing 2 and serves as an example of a cartridge. The developing cartridge 19 is detachably mountable on the drum cartridge 18.

The drum cartridge 18 includes a photosensitive drum 20 as an example of an image-carrying member, a transfer roller 21 as an example of transfer member, and a scorotron charger 22.

The photosensitive drum 20 is formed in a general columnar shape that is elongated in the left-right direction. The photosensitive drum 20 is provided in a rear portion of the drum cartridge 18. The photosensitive drum 20 is provided with a rotational shaft whose central axis is oriented in the left-right direction, and is capable of rotating about the central axis of the drum shaft. Specifically, the photosensitive drum 20 is rotatably supported by a base frame 52 described later. The photosensitive drum 20 is configured to carry a toner image thereon.

The transfer roller 21 is formed in a general columnar shape that is elongated in the left-right direction. The transfer roller 21 is rotatably supported by the base frame 52 (described later) in the rear portion of the drum cartridge 18 so as to face and contact the rear side of the photosensitive drum 20 with pressure. The transfer roller 21 is configured to transfer the toner image from the photosensitive drum 20 onto the sheet S.

More specifically, the transfer roller 21 is disposed rearward of the photosensitive drum 20. A central axis of the transfer roller 21 is positioned slightly lower than the central axis of the photosensitive drum 20. Note that the transfer roller 21 has a lower peripheral surface higher than a lower peripheral surface of the photosensitive drum 20. That is, an imaginary line segment (not shown) connecting the central axis of the transfer roller 21 to the central axis of the photosensitive drum 20 forms an acute angle of approximately 3° with a virtual line (not shown) extending horizontally in the front-rear direction. Accordingly, the weight of the transfer roller 21 does not affect the pressure with which the transfer roller 21 contacts the photosensitive drum 20 (transfer pressure).

The scorotron charger 22 is arranged to confront the upper front side of the photosensitive drum 20 with a gap formed therebetween.

More specifically, the scorotron charger 22 is disposed in a position separated from the transfer roller 21 in a circumferential direction of the photosensitive drum 20. The scorotron charger 22 is disposed such that the virtual line segment (not shown) connecting the central axis of the photosensitive drum 20 with the central axis of the transfer roller 21 forms an angle of approximately 120° with a virtual line segment (not shown) connecting the central axis of the photosensitive drum 20 with a charging wire 23 (described later).

The scorotron charger 22 further includes the charging wire 23 and a grid 24.

The charging wire 23 is arranged in a taut state to extend in the left-right direction and is disposed so as to confront but remain separated from the upper front side of the photosensitive drum 20.

The grid 24 is formed to have a general U-shape in a side view with the opening of the "U" facing diagonally upward and forward so as to surround the charging wire 23 from a lower rear side thereof.

The developing cartridge 19 is disposed on the lower front side of the photosensitive drum 20. The developing cartridge 19 includes a developing-cartridge frame 25.

A toner-accommodating chamber 26 and a development chamber 27 are formed in the developing-cartridge frame 25.

The toner-accommodating chamber 26 and development chamber 27 are provided side by side in the front-rear direction, with a communication opening 28 allowing communication between the two. The toner-accommodating chamber 26 and development chamber 27 have substantially the same capacity as each other.

The toner-accommodating chamber 26 accommodates toner (developer). An agitator 29 is provided in an approximate front-rear and vertical center region of the toner-accommodating chamber 26. In other words, the agitator 29 is positioned lower than the photosensitive drum 20.

In the development chamber 27 has a bottom wall and are formed a supply-roller groove 30, a developing-roller-opposing surface 31, and a lower-film-adhering surface 32 as part of an inner surface (a top surface) of the bottom wall.

The supply-roller groove 30 is formed in a general semi-circular shape conforming to a circumferential surface of a supply roller 33 (described later), with the convex shape of the supply-roller groove 30 facing obliquely downward and rearward.

The developing-roller-opposing surface 31 is formed in a general arc shape that conforms to a circumferential surface of a developing roller 34 (described later). The developing-roller-opposing surface 31 extends continuously from a rear edge of the supply-roller groove 30 toward upward and rearward.

The lower-film-adhering surface 32 is formed continuously with a rear edge of the developing-roller-opposing surface 31 and extends rearward therefrom. That is, the lower-film-adhering surface 32 is arranged higher than the developing-roller-opposing surface 31.

The lower-film-adhering surface 32 is also arranged to confront the bottom portion of the photosensitive drum 20 vertically, with a gap formed therebetween. The lower-film-adhering surface 32 is arranged to overlap the central axis of the photosensitive drum 20 when projected vertically.

The supply roller 33, the developing roller 34, a thickness-regulating blade 35, and a lower film 36 are provided in the development chamber 27.

The supply roller 33 is formed in a general columnar shape that is elongated in the left-right direction. The supply roller 33 is provided in a front region of the development chamber 27 with its bottom portion disposed in the supply-roller groove 30. The supply roller 33 has a length in the left-right direction shorter than that of the sheet S of paper and longer than that of a printing area (maximum printable area) defined in the sheet S. The supply roller 33 includes a rotational shaft oriented in the left-right direction along a central axis of the supply roller 33 and is capable of rotating about the central axis. With this configuration, the supply roller 33 is disposed to the rear side of the toner-accommodating chamber 26 and is arranged at the same approximate height as the toner-accommodating chamber 26 (slightly higher than the toner-accommodating chamber 26). Seal members (not shown) for searing gaps from the developing-cartridge frame 25 are provided on both end portions of the rotational shaft of the supply roller 33 in the left-right direction. The seal members are positioned so as to overlap end portions of the sheet S in the left-right direction when projected in the front-rear direction.

The developing roller 34 is formed in a general columnar shape that is elongated in the left-right direction. The developing roller 34 is provided in a rear region of the development chamber 27 such that its bottom circumferential surface opposes the developing-roller-opposing surface 31 yet remains separated therefrom. The developing roller 31 has a length in the left-right direction longer than that of the supply roller 33. The developing roller 34 is capable of rotating about the central axis thereof.

The developing roller 34 is also disposed to contact the upper rear side of the supply roller 33 and so that its upper and rear portions are exposed outside the development chamber 27 and contact the lower front side of the photosensitive drum 20. In other words, the developing roller 34 is arranged on the upper rear side of the supply roller 33 and the lower front side of the photosensitive drum 20. The central axes of the supply roller 33, developing roller 34, and photosensitive drum 20 are positioned on substantially the same line following a radial direction of the photosensitive drum 20.

The developing roller 34 is also disposed in a position separated from the scorotron charger 22 in the circumferential direction of the photosensitive drum 20 and is arranged such that a virtual line segment (not shown) connecting the central axis of the photosensitive drum 20 to the charging wire 23 forms an angle of approximately 120° with a virtual line segment (not shown) connecting the central axis of the photosensitive drum 20 to the central axis of the developing roller 34. Hence, the developing roller 34, scorotron charger 22, and transfer roller 21 are arranged at substantially equal intervals in the circumferential direction of the photosensitive drum 20.

The thickness-regulating blade 35 has an upper end fixed to a rear end of a top wall defining the development chamber 27. The thickness-regulating blade 35 has a bottom end that contacts the developing roller 34 from the front side thereof.

The lower film 36 has a rear portion fixed to the lower-film-adhering surface 32. A front edge of the lower film 36 contacts the circumferential surface of the developing roller 34 above the developing-roller-opposing surface 31.

(3-2) Scanning Unit

The scanning unit 16 is arranged frontward of the process cartridge 15 to oppose but be separated from the photosensitive drum 20 in the front-rear direction.

The scanning unit 16 irradiates a laser beam L toward the photosensitive drum 20 based on image data, thereby exposing the circumferential surface of the photosensitive drum 20.

More specifically, the scanning unit 16 irradiates the laser beam L rearward to expose the circumferential surface of the photosensitive drum 20 on the front side thereof. In other words, the exposure point at which the photosensitive drum 20 is exposed to light (the circumferential surface on the front side of the photosensitive drum 20) is configured to be on a side opposite to a nip portion N at which the photosensitive drum 20 and transfer roller 21 contact each other with respect to the central axis of the photosensitive drum 20.

At this time, the developing cartridge 19 is arranged beneath an irradiation path of the laser beam L, while the scorotron charger 22 is disposed above the irradiation path of the laser beam L.

Guide parts 37 are provided on inner surfaces of the main casing 2 opposing the space between the scanning unit 16 and photosensitive drum 20 for guiding mounting and removal of the process cartridge 15. When removing the process cartridge 15 from the main casing 2, the guide parts 37 guide the process cartridge 15 so that the developing cartridge 19 mounted in the drum cartridge 18 moves upward, passing through the irradiation path of the laser beam L.

At this time, the various rollers provided in the process cartridge 15 (the transfer roller 21, supply roller 33, and developing roller 34) also pass upward through the irradiation path of the laser beam L.

(3-3) Fixing Unit

The fixing unit 17 is disposed above the rear portion of the drum cartridge 18. More specifically, the fixing unit is disposed above a discharge opening 121 described later and opposes and faces the discharge opening 121. The fixing unit 17 includes a heating roller 38 disposed above the scorotron charger 22, and a pressure roller 39 that contacts the heating roller 38 on an upper rear side thereof with pressure.

Hence, the heating roller 38 is disposed near an upper edge (open side edge) of the grid 24 in the scorotron charger 22, and is disposed above the discharge opening 121 so as to face the discharge opening 121.

(4) Image-Forming Operation

The agitator 29 rotates to supply toner from the toner-accommodating chamber 26 of the developing cartridge 19 to the supply roller 33 through the communication opening 28. The supply roller 33 in turn supplies the toner onto the developing roller 34, at which time the toner is positively tribo-charged between the supply roller 33 and developing roller 34.

The thickness-regulating blade 35 regulates the thickness of toner supplied to the developing roller 34 as the developing roller 34 rotates so that a thin layer of toner of uniform thickness is carried on the surface of the developing roller 34.

In the meantime, the scorotron charger 22 uniformly charges the surface of the photosensitive drum 20. The scanning unit 16 subsequently exposes the surface of the photosensitive drum 20, forming an electrostatic latent image on the circumferential surface of the photosensitive drum 20 based on image data. Next, the toner carried on the developing roller 34 is supplied to the latent image on the circumferential surface of the photosensitive drum 20 so that a toner image (developer image) is carried on the circumferential surface of the photosensitive drum 20.

The rotating pickup roller 11 supplies the sheets S stacked on the sheet-supporting part 9 between the feeding roller 12 and feeding pad 13, and the rotating feeding roller 12 separates the sheets S, conveys each separated sheet S onto the feeding path 14, and supplies the sheets S one at a time to a nip region N (FIG. 7) of the image-forming unit 4 (between the photosensitive drum 20 and transfer roller 21) at a prescribed timing.

The sheet S is conveyed and passed upward (in a passage direction of the sheet S) between the photosensitive drum 20 and transfer roller 21, at which time the toner image is transferred from the photosensitive drum 20 onto the sheet S, forming an image on the sheet S.

Next, the sheet S passes between the heating roller 38 and pressure roller 39. At this time, the heating roller 38 and pressure roller 39 apply heat and pressure to the sheet S to thermally fix the image to the sheet S.

The sheet S is subsequently conveyed toward discharge rollers 40. The discharge rollers 40 discharge the sheet S onto a discharge tray 41 formed on a top surface of the main casing 2.

In this way, the sheet S is supplied from the sheet-supporting part 9 and conveyed along a conveying path that has a general C-shape in a side view, passing first between the photosensitive drum 20 and transfer roller 21 (nip portion N) and next between the heating roller 38 and pressure roller 39, and subsequently being discharged onto the discharge tray 41.

2. Drum Cartridge

Figure 2:
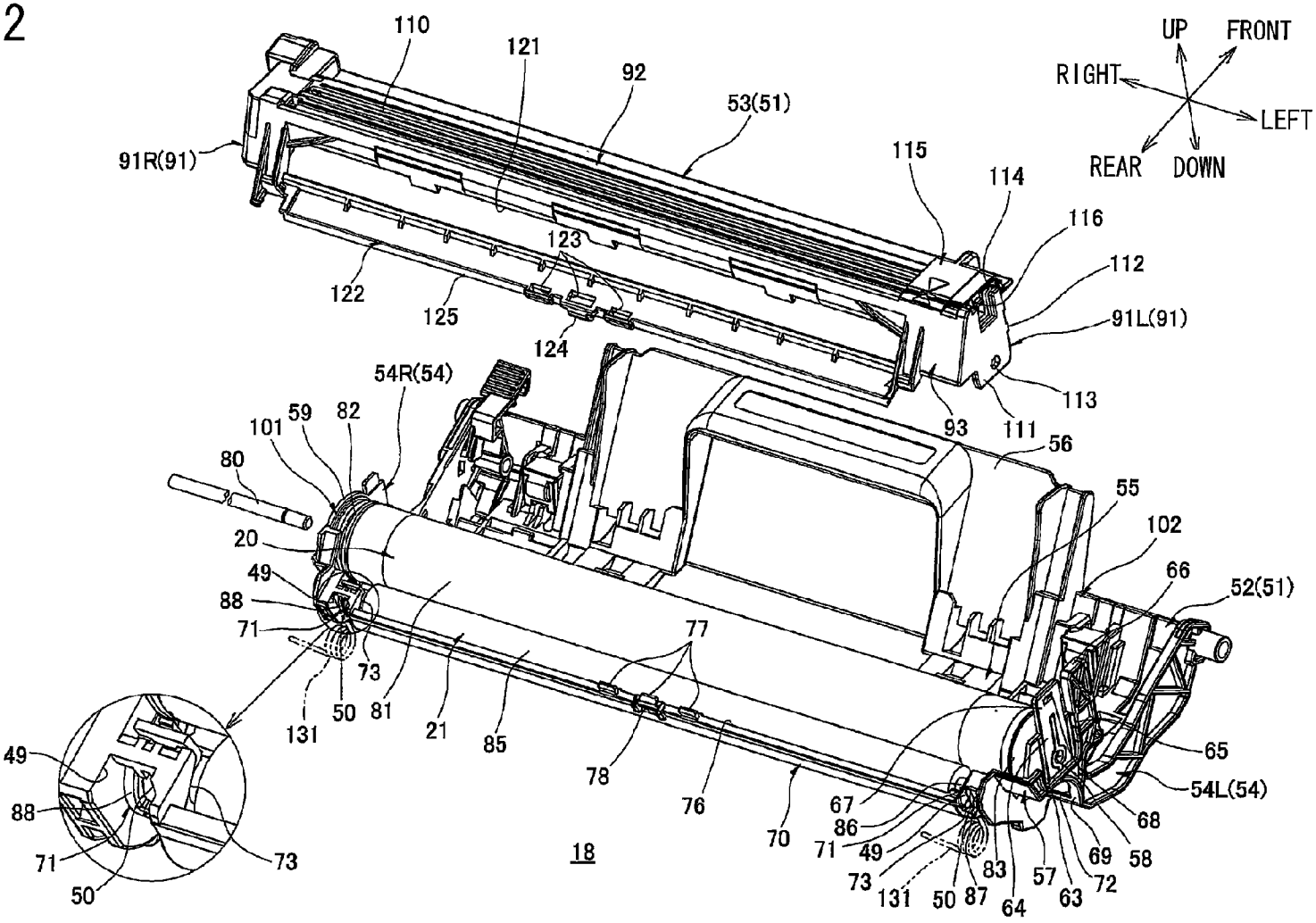
FIG. 2 is an exploded perspective view of a drum cartridge shown in FIG. 1 as viewed from its upper-left side.

As shown in FIG. 2, the drum cartridge 18 includes a drum-cartridge frame 51. The drum-cartridge frame 51 includes the base frame 52 as an example of a first frame, and a cover frame 53 as an example of a second frame.

In the following description of the drum cartridge 18, directions will be given under an assumption that the side of the drum cartridge 18 in which the photosensitive drum 20 is provided is the rear side, and the side in which the scorotron charger 22 is provided is the top. That is, up, down, front, and rear directions related to the drum cartridge 18 differ slightly from the up, down, front, and rear directions related to the printer 1. When the drum cartridge 18 is mounted in the printer 1, the rear side of the drum cartridge 18 faces the upper rear side of the printer 1, and the front side of the drum cartridge 18 faces the lower front side of the printer 1.

(1) Base Frame

The base frame 52 is made of a resin material having rigidity, and is formed by an injection molding method using dies or any other method. The base frame 52 is formed into a shape that has a bottom and which is substantially rectangular in planar view with an upper side thereof opening. Incidentally, the base frame 52 is being molded as the base frame 52 is sandwiched between a first die and a second die. The first die is placed on the open end's side (upper side) of the base frame 52. The second die is disposed on the opposite side (lower side) of the base frame 52 from the first die. After that, the base frame 52 is die-cut toward the open end's side (upper side) in such a way that the first die passes through the open end (upper end) and that the second die is moved to the side (lower side) opposite to the open end's side (upper side).

The base frame 52 includes a pair of left and right sidewalls 54, a lower wall 55, a rear wall 57, and a front wall 56 serving as one example of a wall part.

The left sidewall 54 (referred to as left wall 54L, hereinafter) is formed in a substantially flat-plate shape elongated in the front-rear direction. A fitting concave section 63, a protruding wall 66, an opposing wall 64, and a drum gear exposure section 69 are provided on the rear end portion of the left wall 54L.

The fitting concave section 63 defines a cutout extending downward from an upper edge of the left wall 54L. The cutout is substantially rectangular-shaped in side view, with an upper side thereof opening.

The protruding wall 66 protrudes upward from a front-side portion of the fitting concave section 63 and is formed into a flat-plate shape that is substantially rectangular in side view. The protruding wall 66 is provided with a receiving section 65.

Figure 4:
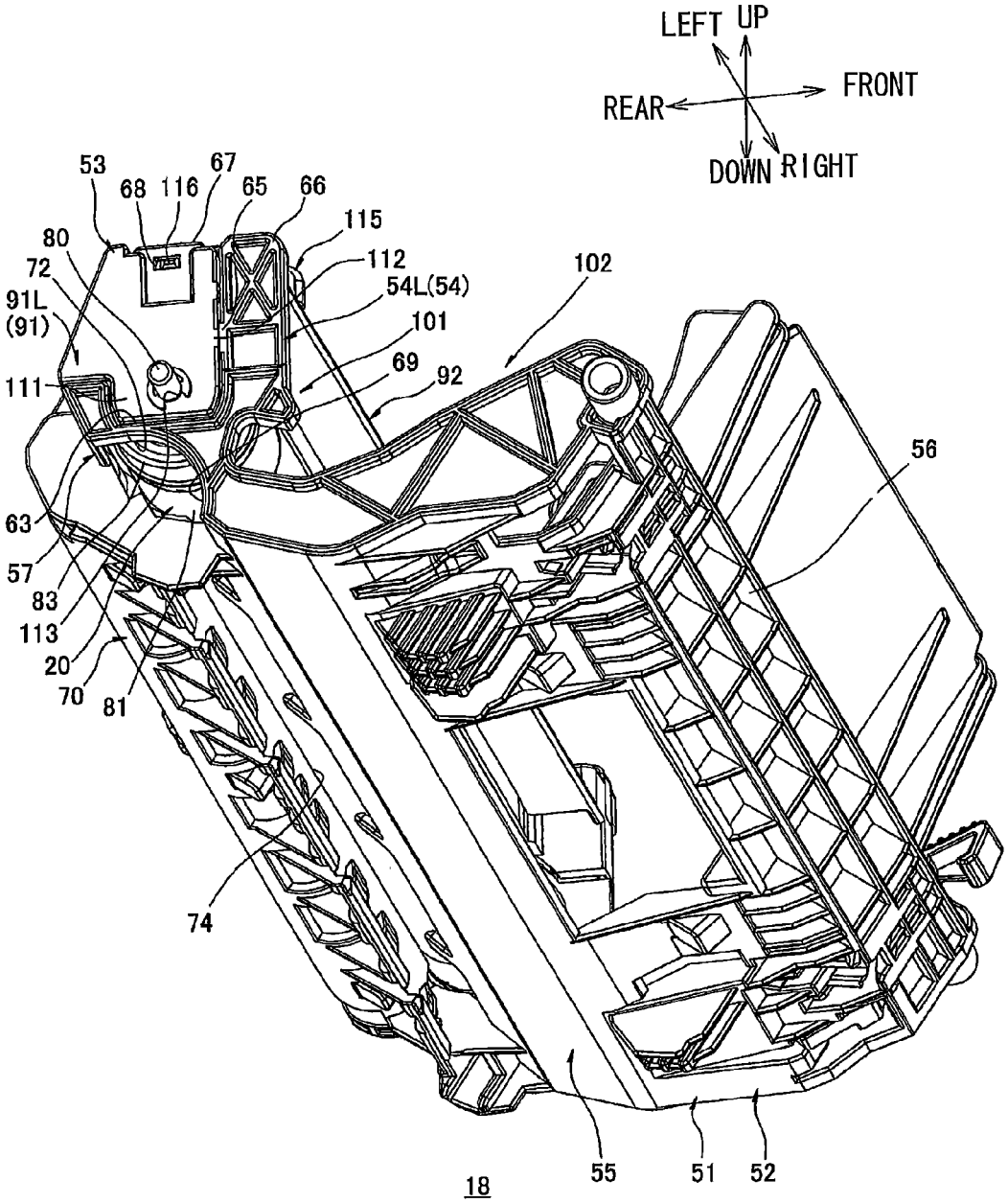
FIG. 4 is a perspective view of the drum cartridge shown in FIG. 1 as viewed from its lower-left side.

As shown in FIG. 4, the receiving section 65 protrudes slightly backward from a rear end portion of the protruding wall 66, and is formed into a substantially rectangular shape in side view with a rear surface thereof extending in the up-down direction. The receiving section 65 is disposed on an outer (left) half area of the rear end portion of the protruding wall 66 and positioned at an almost middle of the rear end portion of the protruding wall 66 in the up-down direction.

The opposing wall 64 is provided on the rear of the protruding wall 66. The opposing wall 64 is formed into an almost flat-plate shape and protrudes upward from an inner (right) half of the left wall 54L. Specifically, the opposing wall 64 protrudes upward from an inner (right) half of the upper edge surface of the fitting concave section 63. On the opposing wall 64, a drum shaft insertion hole 58 and a wire cleaner engagement section 67 are formed.

The drum shaft insertion hole 58 is formed through the opposing wall 64 at the front-rear direction center position of the opposing wall 64, and is formed into an almost circular shape in side view. The inner diameter of the drum shaft insertion hole 58 is slightly larger than (or substantially equal to) the outer diameter of a drum shaft 80 of the photosensitive drum 20 (described later).

The wire cleaner engagement section 67 is formed into a flat-plate shape that is substantially rectangular in side view, and protrudes upward from an upper end portion of the opposing wall 64. The wire cleaner engagement section 67 is formed with a wire cleaner engagement hole 68 in an upper end portion thereof.

The wire cleaner engagement hole 68 has an almost rectangular shape in side view and is formed through the wire cleaner engagement section 67 so as to be oriented in the front-rear direction.

The drum gear exposure section 69 is disposed below the fitting concave section 63 and is formed as an almost arc-shaped concave portion in side view. The drum gear exposure section 69 has a shape concave frontward and upward from the rear lower end surface of the left wall 54L. In other words, the drum gear exposure section 69 extends from the rear end portion of the left wall 54L upward and rearward, and has a center point defined by the arc at the rear and lower side.

Figure 3:
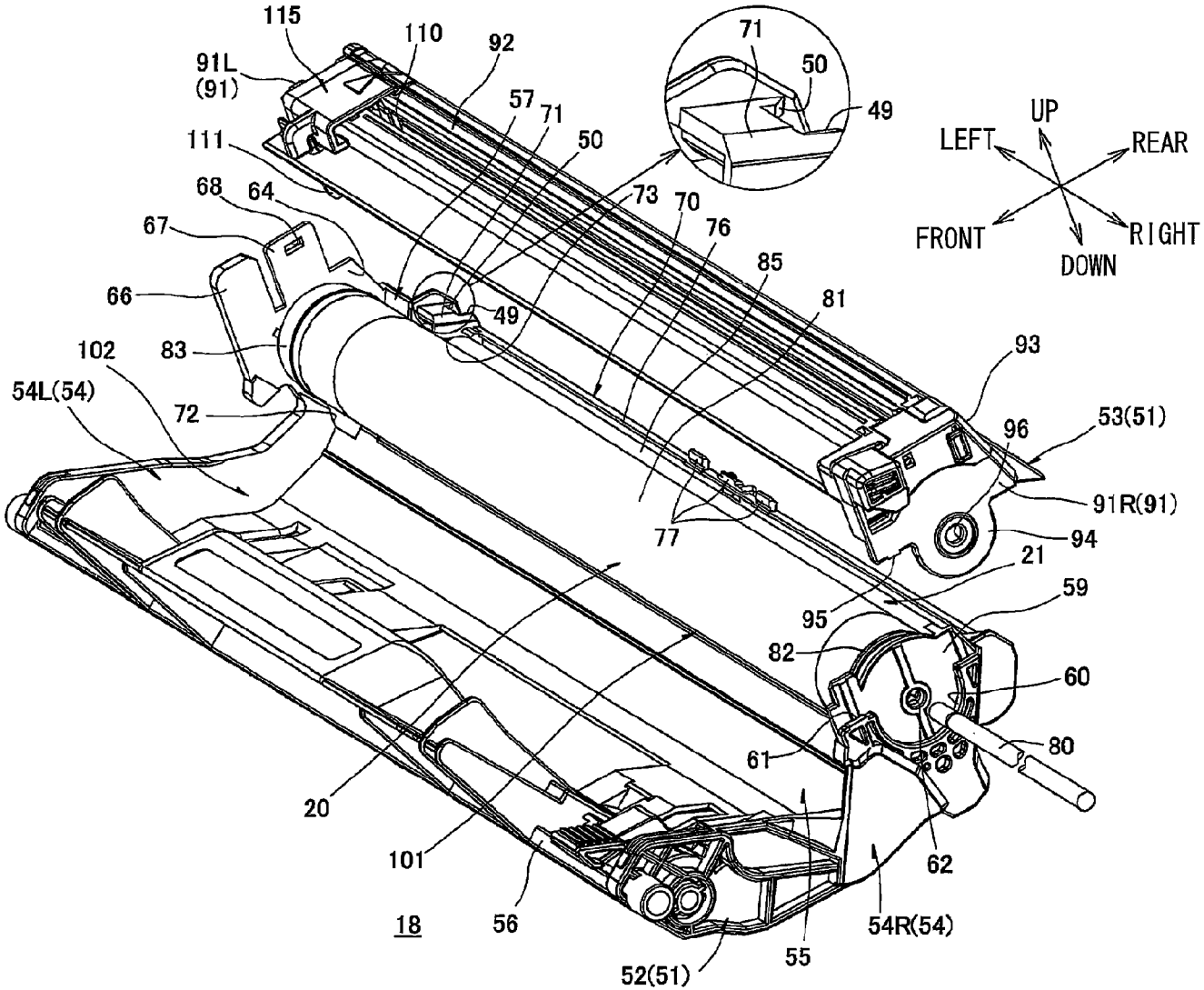
FIG. 3 is an exploded perspective view of the drum cartridge shown in FIG. 1 as viewed from its front-right side.

As shown in FIG. 3, the right sidewall 54 (referred to as right wall 54R, hereinafter) is formed into an almost flat-plate shape elongating in the front-rear direction. In a rear end portion of the right wall 54R, a fitting concave section 60, an opposing wall 59, and a receiving section 61 are formed.

The fitting concave section 60 defines a cutout extending downward from an upper edge of the right wall 54R. The cutout has a substantially semicircular shape in side view, with an upper side thereof opening.

The opposing wall 59 is formed into an almost flat-plate shape and protrudes upward from an inner (left) half of the right wall 54R. Specifically, the opposing wall 59 protrudes upward from an inner (left) half of the upper edge surface of the fitting concave section 60.

A drum shaft insertion hole 62 is formed on the opposing wall 59. The drum shaft insertion hole 62 is disposed at a center portion of the opposing wall 59 in the front-rear direction so as to overlap with (or coaxially with) the drum shaft insertion hole 58 of the left wall 54L when being projected in the left-right direction. The drum shaft insertion hole 62 is formed into an almost circular shape in side view and penetrates through the opposing wall 59. The inner diameter of the drum shaft insertion hole 62 is substantially equal to that of the drum shaft insertion hole 58 of the left wall 54L.

The receiving section 61 is disposed in front of the fitting concave section 60 and is formed into an almost rectangular shape in side view, with an upper surface thereof extending in the front-rear direction. The receiving section 61 protrudes slightly upward from an upper edge portion of the outer (right) half portion of the right wall 54R.

As shown in FIG. 4, the lower wall 55 is formed into an almost flat-plate shape elongated in the left-right direction, and spans between lower end portions of the left and right sidewalls 54L and 54R. Incidentally, a rear end portion of the lower wall 55 is disposed below a front end portion of the drum gear exposure section 69.

Figure 7:
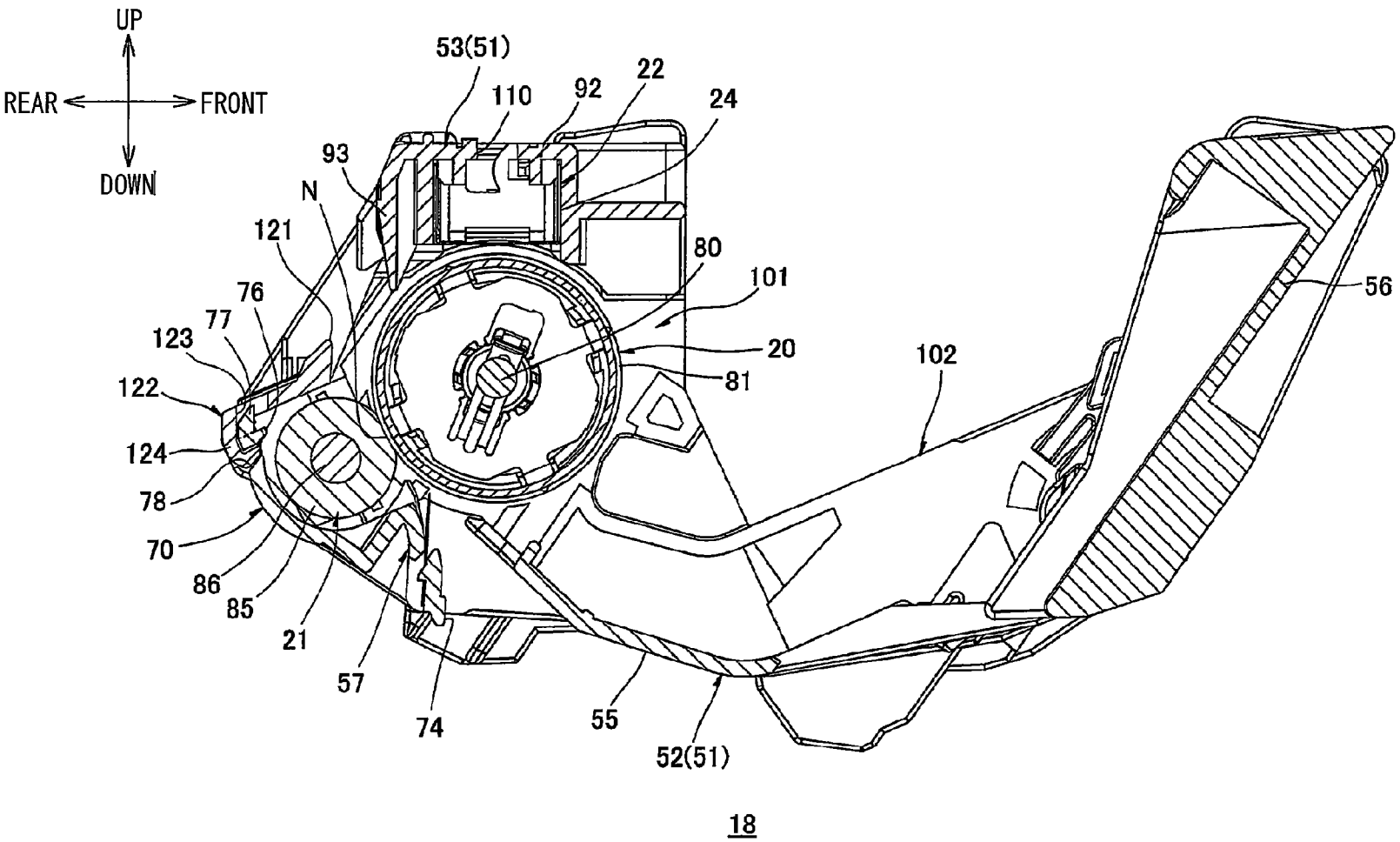
FIG. 7 is a cross-sectional view of the developing cartridge taken along a line VII-VII of FIG. 5.

As shown in FIGS. 2, 4, and 7, the rear wall 57 is disposed rearward of a rear end portion of the lower wall 55 and separated from the lower wall 55. The rear wall 57 has an almost flat-plate shape elongated in the left-right direction, and spans between rear end portions of the left and right sidewalls 54L and 54R. A sheet-feeding opening 74 as an example of a second opening is defined between the rear wall 57 and the lower wall 55. That is, the sheet-feeding opening 74 is formed in the base frame 52. The sheet-feeding opening 74 allows the sheet S being conveyed toward the nip portion N (between the photosensitive drum 20 and the transfer roller 21).

The rear wall 57 further includes a transfer roller support section 70 as an example of a support portion and a second supporting portion. A drum gear exposure opening 72 is formed on the rear wall 57.

The transfer roller support section 70 supports the transfer roller 21 and is formed into an almost partially cylindrical shape extending in the left-right direction and protrudes backward from the rear wall 57. The left and right end portions of the transfer roller support section 70 are closed; the transfer roller support section 70 is open toward the front upper side. The left end portion of the transfer roller support section 70 is disposed at an inner position than the left wall 54L in the left-right-direction (to the right of left wall 54L). The right end portion of the transfer roller support section 70 is disposed at an inner position than the right wall 54R in the left-right-direction (to the left of the right wall 54R).

One transfer roller shaft guide section 71 is provided on each of left and right end portions of the transfer roller support section 70.

The transfer roller shaft guide section 71 extends in the front-rear direction, and is formed into an almost square tube shape, with front and rear end portions thereof opening.

The transfer roller shaft guide section 71 is formed with a guide groove 73 on an inner wall thereof in the left-right-direction. The guide groove 73 is formed through the transfer roller shaft guide section 71 and is oriented in the front-rear direction (more specifically, or in a diagonally direction from the front upper side to the rear lower side) (See FIG. 8). The groove width of the guide groove 73 (or the up-down-direction length) is slightly wider than or equal to the outer diameter of a transfer roller shaft 86 (described later). A concave section 49 and an inclined section 50 are formed on an upper wall of the transfer roller shaft guide section 71.

The concave section 49 is formed into an almost rectangular shape in planar view that is depressed frontward from a rear edge of the transfer roller shaft guide section 71.

One inclined section 50 is provided in an upper end portion of the right transfer roller shaft guide section 71 (see an enlarged view of FIG. 2), and another inclined section 50 is provided in an upper end portion of the left transfer roller shaft guide section 71 (see an enlarged view of FIG. 3). The inclined section 50 is formed into an almost trapezoidal shape in planar view so as to protrude into the concave section 49 from an inner surface of the left wall of the transfer roller shaft guide section 71. A rear surface of the inclined section 50 is gradually inclined rightward from the rear end thereof.

As shown in FIGS. 2 and 3, a protrusion 76 as an example of a protruding portion, a plurality of (or three) fitting projections 77, and an engagement concave section 78 as an example of an engaged section are provided on the rear upper end portion of the transfer roller support section 70.

The protrusion 76 is disposed between the two transfer roller shaft guide sections 71. The protrusion 76 protrudes forward from an inner surface (front surface of the rear upper end portion) of the transfer roller support section 70 and extends in the left-right direction. In other words, the protrusion 76 protrudes from the rear upper end portion toward the transfer roller 21.

The plurality of fitting projections 77 are positioned at an almost center portion of the transfer roller support section 70 in the left-right-direction, and are provided in parallel to each other in the left-right direction at equal intervals. Each fitting projection 77 is formed into an almost rectangular shape in rear view and protrudes upward from the upper surface of the rear upper end portion of the transfer roller support section 70.

At the almost left-right-direction center of the transfer roller support section 70, the engagement concave section 78 is formed into a rectangular shape in rear view and is recessed forward from the rear surface of the transfer roller support section 70.

Figure 5:
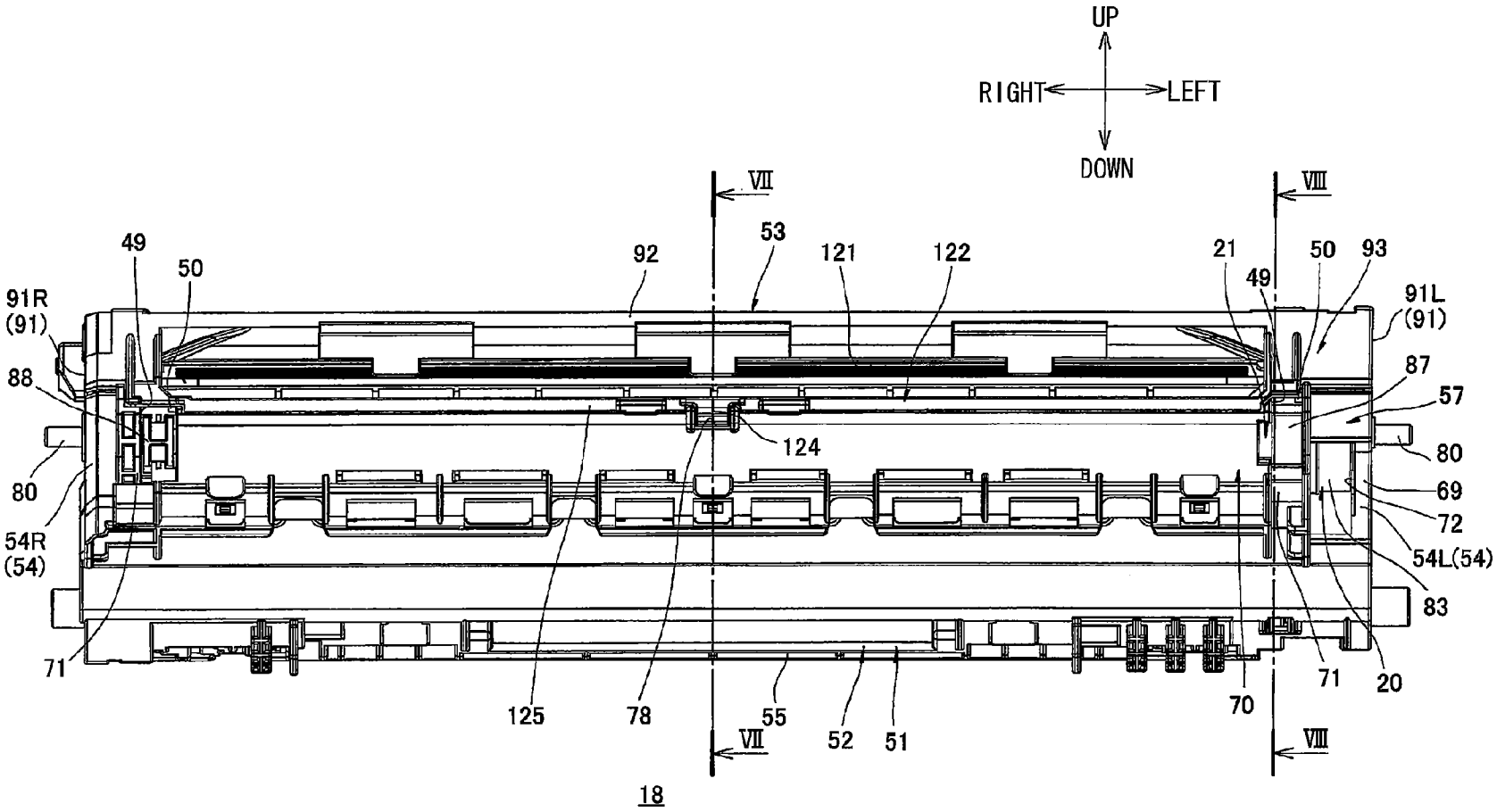
FIG. 5 is a back view of the drum cartridge shown in FIG. 1.

The drum gear exposure opening 72 is defined between the left wall 54L and the left end portion of the transfer roller support section 70, and is a through-hole formed into an almost rectangular shape in rear view so as to correspond to the drum gear exposure section 69 (See FIG. 5).

The front wall 56 is disposed between front end portions of the two sidewalls 54 and extends upward seamlessly from the front end portion of the lower wall 55. The front wall 56 is formed into an almost flat-plate shape elongated in the left-right direction. That is, the front wall 56 is separated from the transfer roller support section 70 in the front-rear direction while facing the transfer roller support section 70.

A drum support section 101 for supporting the photosensitive drum 20 therein is provided between the opposing wall 59 of the right wall 54R and the opposing wall 64 of the left wall 54L, in an area of the base frame 52 that is located in front of the transfer roller support section 70. The drum support section 101 is one example of a first supporting portion.

A developing cartridge mounting section 102 is provided on a portion of the base frame 52 that is located in front of the drum support section 101 (or the portion defined by the lower wall 55, the front wall 56, and front portions of the right wall 54R and left wall 54L). The developing cartridge 19 can be mounted in the developing cartridge mounting section 102. The developing cartridge section 102 is one example of a mounted portion. As shown in FIG. 2, the developing cartridge section 102 is positioned opposite to the transfer roller support section 70 with respect to the drum support section 101. In other words, the transfer roller support section 70, the drum support section 101, and the developing cartridge section 102 are arranged in the rear-to-front direction (arranged direction). The front wall 56 faces the transfer roller support section 70 in the arranged direction.

(2) Cover Frame

The cover frame 53 is disposed above the rear end portion of the base frame 52. The cover frame 53 is made of a flame-retardant resin material, and is formed by an injection molding method using dies or any other method. The cover frame 53 is formed into an almost square tube shape extending in the left-right direction and opening toward the lower and front sides.

The cover frame 53 includes a pair of left and right sidewalls 91, an upper wall 92, and a rear wall 93.

As shown in FIG. 2, the left sidewall 91 (referred to as left wall 91L, hereinafter) is formed into an almost flat-plate shape extending in the up-down direction. A fitting convex section 111 and a positioning section 112 are formed on the left wall 91L.

The fitting convex section 111 is formed into an almost rectangular shape in side view, and protrudes downward from a lower end portion of the left wall 91L. The up-down-direction length (protruding length) of the fitting convex section 111 is slightly shorter than the up-down-direction length (depth) of the fitting concave section 63 of the left wall 54L of the base frame 52. The front-rear direction length of the fitting convex section 111 is slightly shorter than the front-rear direction length of the fitting concave section 63 of the left wall 54L of the base frame 52.

A drum shaft insertion hole 113 is formed on the fitting convex section 111. The drum shaft insertion hole 113 is formed at the center in the front-rear direction of the fitting convex section 111, and is a through hole having an almost circular shape in side view. The inner diameter of the drum shaft insertion hole 113 is slightly larger than (or almost equal to) the outer diameter of the drum shaft 80 of the photosensitive drum 20.

The positioning section 112 is formed at almost center of the left wall 91L in the up-down-direction. The positioning section 112 is formed into an almost rectangular shape in side view, and slightly protrudes frontward from a front edge thereof. A front surface of the positioning section 112 extends in the up-down direction. The length in the up-down-direction of the positioning section 112 is shorter than the length in the up-down-direction of the receiving section 65 of the left wall 54L of the base frame 52.

As shown in FIG. 3, the right sidewall 91 (referred to as a right wall 91R, hereinafter) is formed into a flat-plate shape that is substantially rectangular in side view, in such a way as to extend in the up-down direction. The right wall 91R is provided with a fitting convex section 94 and a positioning section 95.

The fitting convex section 94 is formed into an almost semicircular shape in side view, and protrudes downward from a lower end portion of the right wall 91R. The up-down-direction length (protruding length) of the fitting convex section 94 is slightly shorter than the up-down-direction length (depth) of the fitting concave section 60 of the right wall 54R of the base frame 52. The front-rear direction length of the fitting convex section 94 is slightly shorter than the front-rear direction length of the fitting concave section 60 of the right wall 54R of the base frame 52.

A drum shaft insertion hole 96 is formed on the fitting convex section 94. The drum shaft insertion hole 96 is positioned at center of the fitting convex section 94 in the front-rear direction, and is a through hole formed into an almost circular shape in side view. The drum shaft insertion hole 96 corresponds to and overlaps the drum shaft insertion hole 113 of the left wall 91L when being projected in the left-right direction. The inner diameter of the drum shaft insertion hole 96 is equal to the inner diameter of the drum shaft insertion hole 113 of the left wall 91L.

The positioning section 95 is formed in front of the fitting convex section 94 and slightly protrudes downward from a lower edge of the right wall 91R. The positioning section 95 has an almost rectangular shape in side view, with a lower surface thereof extending in the front-rear direction. The length of the positioning section 95 in the front-rear direction is shorter than that of the receiving section 61 of the right wall 54R of the base frame 52.

As shown in FIG. 2, the upper wall 92 extends in the left-right direction and spans between upper end portions of the two sidewalls 91. The upper wall 92 is formed into an almost square tube shape (See FIG. 8) with a bottom side being opened. Inside the upper wall 92, the above-described scorotron charger 22 is supported (See FIG. 8).

A vent opening 110 and a wire cleaner engagement section insertion hole 114 are formed on the upper wall 92. The vent opening 110 is formed on an upper end portion of the upper wall 92, and has an almost linear shape extending in the left-right direction and along the charging wire 23 of the scorotron charger 22.

The wire cleaner engagement section insertion hole 114 is formed on the left end portion of the upper wall 92, and positioned in a boundary with the left wall 91L. The wire cleaner engagement section insertion hole 114 is formed into an almost rectangular shape in planar view, in such a way as to be elongated in the front-rear direction and pass through the upper wall 92 in the up-down direction.

The upper wall 92 supports a wire cleaner 115. The wire cleaner 115 is supported in the upper end portion of the upper wall 92 and is slidable in the left-right direction. The wire cleaner 115 is formed into a flat-plate shape that is substantially rectangular in planar view.

The wire cleaner 115 includes a cleaning section 117 (See FIG. 8) and an engagement projection 116.

Figure 8:
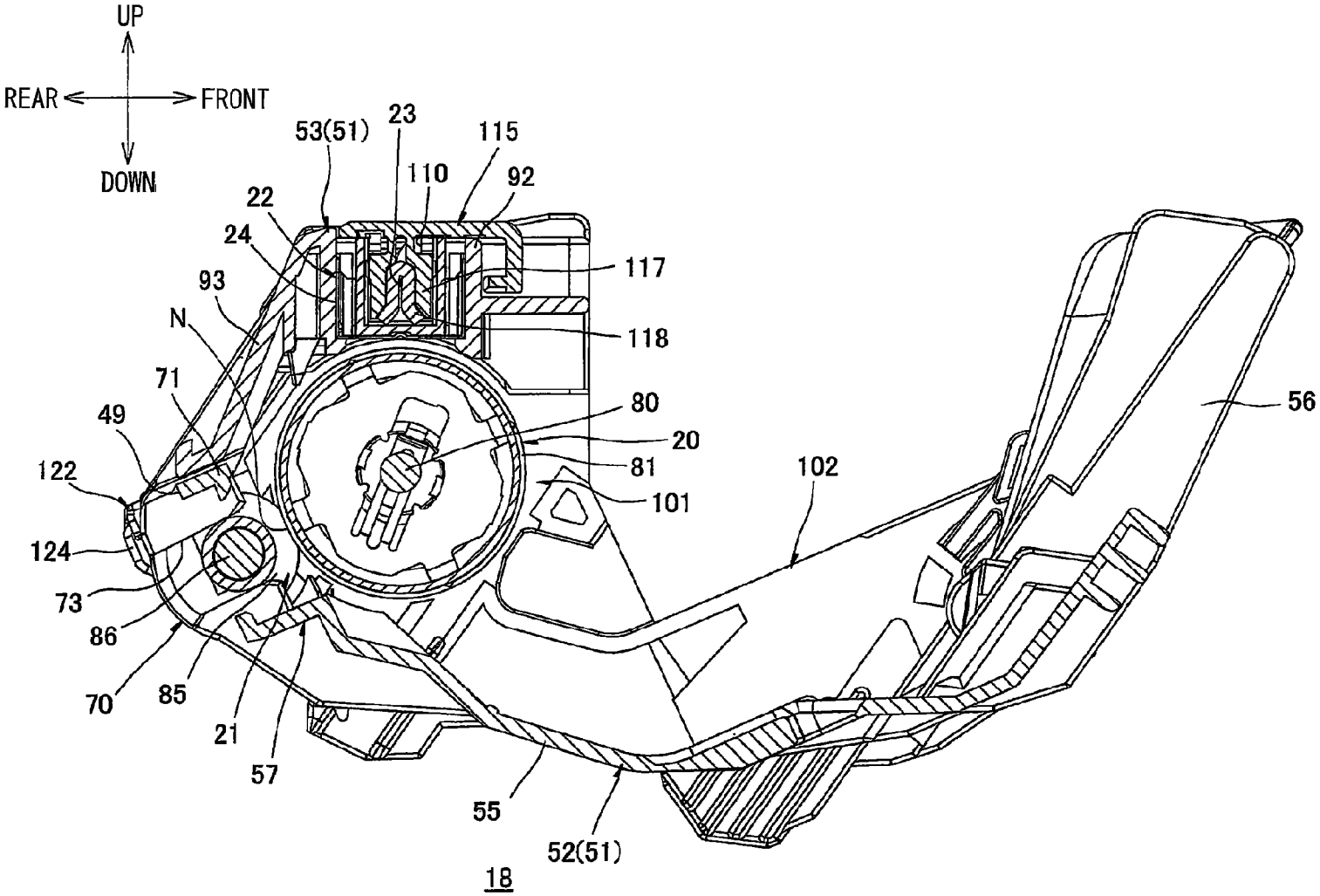
FIG. 8 is a cross-sectional view of the developing cartridge taken along a line VIII-VIII of FIG. 5.

The cleaning section 117 is disposed in the grid 24 via the vent opening 110 (See FIG. 8). The cleaning section 117 holds the charging wire 23 via a cleaning member 118 such as sponge or non-woven fabric (See FIG. 8).

The engagement projection 116 is formed into an almost rectangular column shape and protrudes leftward from a left surface of the wire cleaner 115. The up-down-direction outer size and front-rear direction outer size of the engagement projection 116 are shorter than the up-down-direction inner size and front-rear direction inner size of the wire cleaner engagement hole 68 of the base frame 52, respectively.

The rear wall 93 spans between rear end portions of the sidewalls 91. The rear wall 93 extends seamlessly from the rear end portion of the upper wall 92 rearward and downward, and is formed into an almost flat-plate shape that is elongated in the left-right direction. The discharge opening 121 serving as an example of a first opening, and a covering section 122 are formed on the rear wall 93 of the cover frame 53.

The discharge opening 121 is defined as an opening having an almost rectangular shape in rear view that is elongated in the left-right direction and that extends from the rear lower end portion of the rear wall 93 toward the front upper side. The discharge opening 121 is formed at the central portion of the rear wall 93 in the left-right-direction so as to correspond to a portion between the transfer roller shaft guide sections 71 of the transfer roller support section 70 of the base frame 52. The left-right-direction length of the discharge opening 121 is substantially equal to the left-right-direction length of the portion between the transfer roller shaft guide sections 71. The discharge opening 121 allows a sheet S that has passed between the photosensitive drum 20 and the transfer roller 21 to pass therethrough toward the fixing unit 17.

The covering section 122 is provided in the rear lower end portion of the discharge opening 121 and covers and closes the rear lower end portion of the discharge opening 121. The covering section 122 is formed into a flat-plate shape that is substantially rectangular in planar view and that extends in the left-right direction. The left-right-direction length of the covering section 122 is substantially equal to the left-right-direction length of the portion between the transfer roller shaft guide sections 71 of the transfer roller support section 70.

In the rear end portion of the covering section 122, a contact portion 125, a plurality of (or three) fitting holes 123, and an engagement claw 124 that is one example of an engaging portion, are formed.

The contact portion 125 is formed as a protrusion protruding downward from the rear edge of the covering section 122 and extending in the left-right direction.

The plurality of fitting holes 123 are arranged in parallel at equal intervals in the left-right direction, and are disposed on the almost center portion of the covering section 122 in the left-right-direction. Each fitting hole 123 is a through hole formed into an almost rectangular shape in planar view.

The engagement claw 124 is disposed at almost center in the left-right-direction of the covering section 122, and has an almost hook shape protruding downward from the lower surface of the covering section 122 with the tip portion (lower end portion) thereof being bent toward the front side. In other words, the engagement claw 124 extends from the cover frame 53 toward the base frame 52 in the passage direction of the sheet S (or the direction from the lower side toward the upper side); the tip portion (lower end portion) of the engagement claw 124 is bent frontward and protrudes toward a conveying path (passage path; see an imaginary line in FIG. 1) of the sheet S.

The up-down-direction outer size and left-right-direction outer size of the tip (bent portion) of the engagement claw 124 is shorter than the up-down-direction outer size and left-right-direction outer size of the engagement concave section 78 (See FIGS. 5 and 7), respectively.

(3) Transfer Roller and Photosensitive Drum

As described above, the transfer roller 21 and the photosensitive drum 20 are supported in the drum cartridge 18. Incidentally, the center of gravity of the drum cartridge 18 is deviated rearward from the center in the front-rear direction, as the transfer roller 21 and the photosensitive drum 20 are supported by the rear end portion of the drum cartridge 18.

The transfer roller 21 includes a transfer roller shaft 86, a roller body 85, a transfer roller bearing 87, and a transfer roller electrode 88.

The roller body 85 is disposed between the transfer roller shaft guide sections 71. The roller body 85 is made of a conductive soft resin (such as rubber, for example), and is formed into an almost cylindrical shape extending in the left-right direction. The inner diameter of the roller body 85 is substantially equal to the outer diameter of the transfer roller shaft 86. The roller body 85 has a length in the left-right direction shorter than that of the sheet S of paper and longer than that of the printing area (maximum printable area) defined in the sheet S.

The transfer roller shaft 86 is inserted into the roller body 85 in such a way as to be unable to rotate relatively. The transfer roller shaft 86 is made of metal, and has an almost columnar shape that extends in the left-right direction. The transfer roller shaft 86 has a length in the left-right-direction longer than the length of the roller body 85; the left and right end portions of the transfer roller shaft 86 protrude from the roller body 85. Incidentally, the protruding length of the left end portion of the transfer roller shaft 86 is longer than the protruding length of the right end portion of the transfer roller shaft 86. The left and right end portions of the transfer roller shaft 86 protrude into the corresponding transfer roller shaft guide sections 71, and are fitted into the guide grooves 73 of the corresponding transfer roller shaft guide sections 71 so as to be able to rotate relatively (See FIG. 8). Accordingly, the transfer roller 21 is supported by the base frame 52 so as to be movable in the front-rear direction (or, more specifically, in a direction from the front upper side to the rear lower side) along the guide grooves 73.

The transfer roller bearing 87 is provided at the left end portion of the transfer roller shaft 86. The transfer roller bearing 87 is made of an insulating hard resin, and is formed into an almost cylindrical shape that extends in the left-right direction. The inner diameter of the transfer roller bearing 87 is slightly larger than (or almost equal to) the outer diameter of the transfer roller shaft 86. In the left transfer roller shaft guide section 71, the transfer roller bearing 87 is fitted onto the transfer roller shaft 86 so as to be rotatable relatively (or fitted from the radial-direction outer side of the transfer roller shaft 86). A rear end portion of the transfer roller bearing 87 is exposed to the inside of the concave section 49 of the left transfer roller shaft guide section 71 when viewed from above.

The transfer roller electrode 88 is provided on the right end portion of the transfer roller shaft 86. The transfer roller electrode 88 is made of a conductive hard resin, and is formed into a semi-cylindrical shape that extends in the left-right direction and is opened forward. The inner diameter of the transfer roller electrode 88 is slightly larger than (or substantially equal to) the outer diameter of the transfer roller shaft 86. In the right transfer roller shaft guide section 71, the transfer roller electrode 88 is fitted onto the transfer roller shaft 86 from the rear side so as to be rotatable relatively (or fitted from the radial-direction outer side of the transfer roller shaft 86). A rear end portion of the transfer roller electrode 88 is exposed to the inside of the concave section 49 of the right transfer roller shaft guide section 71 when viewed from above.

The photosensitive drum 20 includes a drum body 81, a flange member 82, a drum gear 83, and a drum shaft 80.

The drum body 81 is disposed in front of the transfer roller 21 and between the opposing wall 59 of the right wall 54R and the opposing wall 64 of the left wall 54L. The drum body 81 has an almost cylindrical shape extending in the left-right direction. More specifically, the drum body 81 includes a metal element tube having a substantially cylindrical-shape and extending in the left-right direction, and a resin photosensitive layer covering the peripheral surface of the element tube. The drum body 81 has a length in the left-right-direction length longer than the left-right-direction length of the sheet S of paper.

The flange member 82 is fitted to the right end portion of the drum body 81 so as to be unable to rotate relatively. The flange member 82 is formed into an almost disc shape that has a thickness in the left-right direction. The flange member 82 has an insertion through hole (not shown) into which the drum shaft 80 is inserted, at a central portion in a radial-direction thereof.

The drum gear 83 is fitted to the left end portion of the drum body 81 in such a way as to be placed between the left wall 54L of the base frame 52 and the left end portion of the transfer roller support section 70 (See FIG. 5) and to be unable to rotate relatively. The drum gear 83 is formed into an almost disc shape having a thickness in the left-right direction, and has gear teeth on the peripheral surface thereof. The drum gear 83 has an insertion through hole (not shown) into which the drum shaft 80 is inserted, at a central portion in a radial-direction thereof. A rear lower end portion of the drum gear 83 is exposed to the rear lower side via the drum gear exposure opening 72. The rear lower end portion of the drum gear 83 is exposed from the drum gear exposure section 69 of the left wall 54L in left side view (See FIGS. 5 and 6A).

As shown in FIG. 4, the drum shaft 80 is inserted into the drum body 81 in such a way as to extend along a central axis of the photosensitive drum 20. The drum shaft 80 is made of metal, and is formed into an almost columnar shape that extends in the left-right direction. The drum shaft 80 has a length in the left-right direction longer than that of the drum body 81. The left end portion of the drum shaft 80 is inserted into the drum shaft insertion hole 58 of the left wall 54L of the base frame 52 and in the drum shaft insertion hole 113 (See FIG. 6A) of the left wall 91L of the cover frame 53, so as to be capable of rotating. The right end portion of the drum shaft 80 is inserted into the drum shaft insertion hole 62 of the right wall 54R of the base frame 52 and in the drum shaft insertion hole 96 (See FIG. 6B) of the right wall 91R of the cover frame 53, so as to be capable of rotating.

(4) Assembling of Drum Cartridge

When the drum cartridge 18 is assembled, first, the transfer roller 21 and the photosensitive drum 20 (excluding the drum shaft 80) are mounted on the base frame 52 as shown in FIGS. 2 and 3.

Then, the cover frame 53 is mounted on the rear end portion of the base frame 52 from above so as to cover the transfer roller 21 and the photosensitive drum 20.

More specifically, the tip (lower end portion) of the engagement claw 124 of the cover frame 53 is fitted into the engagement concave section 78 of the base frame 52 from the rear side. At the same time, the contact portion 125 of the cover frame 53 is set in contact with the upper surface of the rear end portion of the transfer roller support section 70 of the base frame 52. That is, the rear upper end portion of the transfer roller support section 70 is a receiving portion for receiving the contact portion 125 comes in contact with.

At this time, the tip portion (lower end portion) of the engagement claw 124 of the cover frame 53 and the engagement concave section 78 of the base frame 52 are loosely engaged with a gap in the up-down direction therebetween (or a gap equivalent to a difference in the up-down-direction between the outer size of the tip of the engagement claw 124 and the outer size of the engagement concave section 78) (See FIG. 7).

Then, the fitting convex section 94 of the right wall 91R of the cover frame 53 is fitted into the fitting concave section 60 of the right wall 54R of the base frame 52. At the same time, the fitting convex section 111 of the left wall 91L of the cover frame 53 is fitted into the fitting concave section 63 of the left wall 54L of the base frame 52. Incidentally, the wire cleaner 115 is disposed in the middle of the cover frame 53 in the left-right direction at this time.

As a result, the fitting projections 77 of the base frame 52 are loosely fitted into the corresponding fitting holes 123 of the cover frame 53. The wire cleaner engagement section 67 of the base frame 52 is inserted into the wire cleaner engagement section insertion hole 114 of the cover frame 53.

The drum shaft insertion hole 113 of the left wall 91L of the cover frame 53 is set so as to face the drum shaft insertion hole 58 of the left wall 54L of the base frame 52. The drum shaft insertion hole 96 of the right wall 91R of the cover frame 53 is set so as to face the drum shaft insertion hole 62 of the right wall 54R of the base frame 52.

Figure 6A:
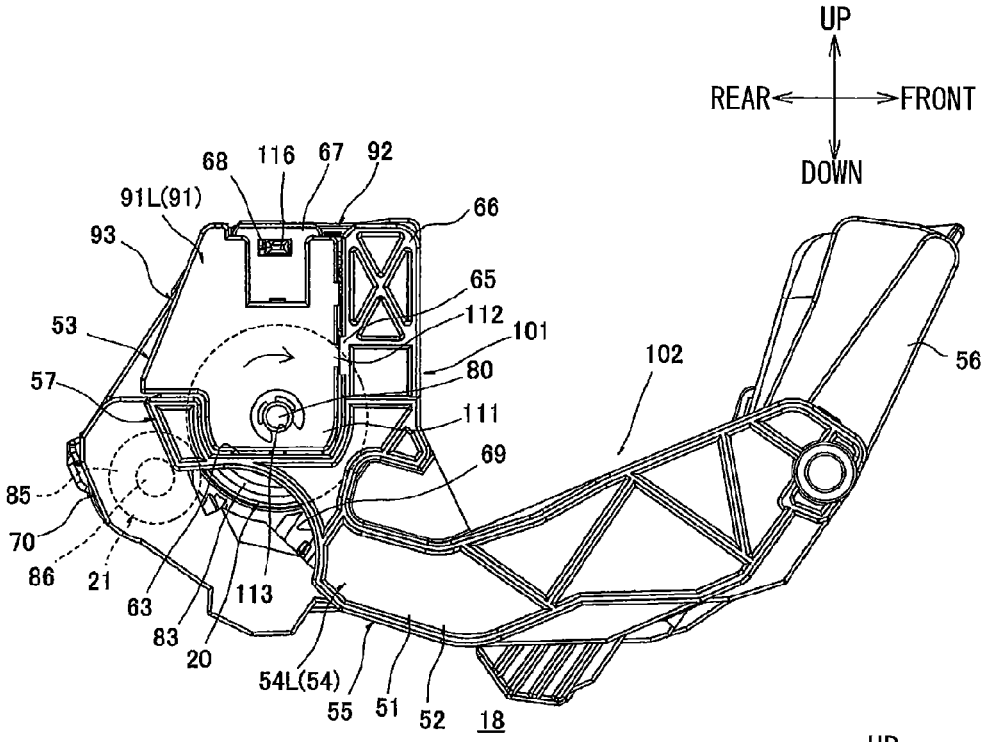
FIG. 6A is a left side view of the drum cartridge shown in FIG. 1.

The positioning section 112 of the left wall 91L of the cover frame 53 is disposed so as to face the rear side of the receiving section 65 of the left wall 54L of the base frame 52 (See FIG. 6A). The positioning section 95 of the right wall 91R of the cover frame 53 is disposed in so as to face the upper side portion of the receiving section 61 of the right wall 54R of the base frame 52 (See FIG. 6B).

Incidentally, the wire cleaner 115 is placed in a left end portion of the cover frame 53. The engagement projection 116 of the wire cleaner 115 is engaged into the wire cleaner engagement hole 68 of the wire cleaner engagement section 67.

Next, the drum shaft 80 is inserted into the flange member 82, the drum gear 83, and the drum body 81 through each of the drum shaft insertion holes (58, 62, 96, 113) of the base frame 52 and the cover frame 53.

Then, the photosensitive drum 20 is rotatably supported by the base frame 52 and the cover frame 53 at both end portions of the drum shaft 80 in the left-right direction. The base frame 52 and the cover frame 53 are integrally connected via the drum shaft 80.

In this manner, the assembling of the drum cartridge 18 is completed. The cover frame 53 is disposed downstream from the nip portion N in the passage direction of the sheet S when the assembling of the drum cartridge 18 is completed.

In the state shown in FIG. 7, if an upward force is applied to the peripheral portion of the discharge opening 121 in the assembled drum cartridge 18, or if the photosensitive drum 20 is rotated as described later, the cover frame 53 is slightly moved clockwise in left side view around the drum shaft 80 (movement of about a tolerance). At this time, the engagement claw 124 is moved toward almost the front upper side, and the tip (lower end portion) thereof is more deeply fitted into the engagement concave section 78 of the base frame 52.

3. Drive Input to Process Cartridge

As shown in FIG. 1, when the process cartridge 15 is being mounted in the main casing 2, the biasing members 131 (FIG. 2) are guided to the inclined sections 50 of the transfer roller shaft guide sections 71 (See FIGS. 2 and 3), respectively. As a result, the left biasing member 131 comes in contact with the rear end portion of the transfer roller bearing 87 of the transfer roller 21 that is exposed in the left concave section 49 (See FIGS. 2 and 3) of the transfer roller shaft guide section 71, and the right biasing member 131 comes in contact with the rear end portion of the transfer roller electrode 88 that is exposed in the right concave section 49 (See FIGS. 2 and 3) of the transfer roller shaft guide section 71. Incidentally, power is supplied from a power source (not shown) provided in the main casing 2 to the transfer roller electrode 88 via the right biasing member 131.

The transfer roller 21 is pressed by a pressing force of the biasing members 131 forward so as to move toward the photosensitive drum 20 (See FIGS. 2 and 3).

As the process cartridge 15 is mounted in the main casing 2, a drive gear (not shown) provided in the main casing 2 meshes with the rear end portion of the drum gear 83 (See FIG. 4).

In this state, the photosensitive drum 20 rotates clockwise in left side view as indicated by arrow in FIG. 6A when a drive force is input to the drum gear 83 via the drive gear (not shown).

By the rotation of the photosensitive drum 20, the cover frame 53 is pressed against the base frame 52 in a clockwise direction around the drum shaft 80 of the photosensitive drum 20 in left side view (FIG. 6A).

Figure 6B:
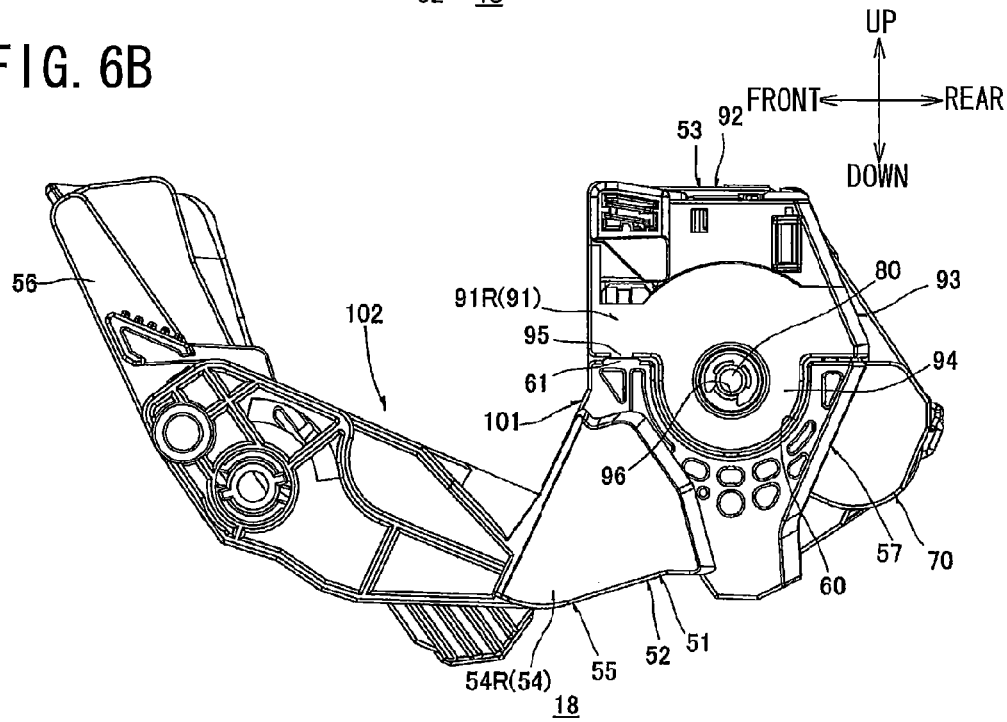
FIG. 6B is a right side view of the drum cartridge shown in FIG. 1.

More specifically, the rotation of the photosensitive drum 20 presses the positioning section 112 of the left wall 91L forward (toward the receiving section 65 of the left wall 54L of the base frame 52) (See FIG. 6A), and presses the positioning section 95 of the right wall 91R downward (toward the receiving section 61 of the right wall 54R of the base frame 52) (See FIG. 6B).

In this manner, the cover frame 53 is positioned relative to the drum support section 101 of the base frame 52.

As the photosensitive drum 20 is rotated clockwise in left side view, the transfer roller 21 follows the rotation of the photosensitive drum 20, and is therefore rotated counter-clockwise in left side view. The transfer roller 21 is rotated by friction caused by the pressing of the peripheral surface of the transfer roller 21 against the peripheral surface of the photosensitive drum 20. The transfer roller 21 does not have a gear or the like.

Figure 9:
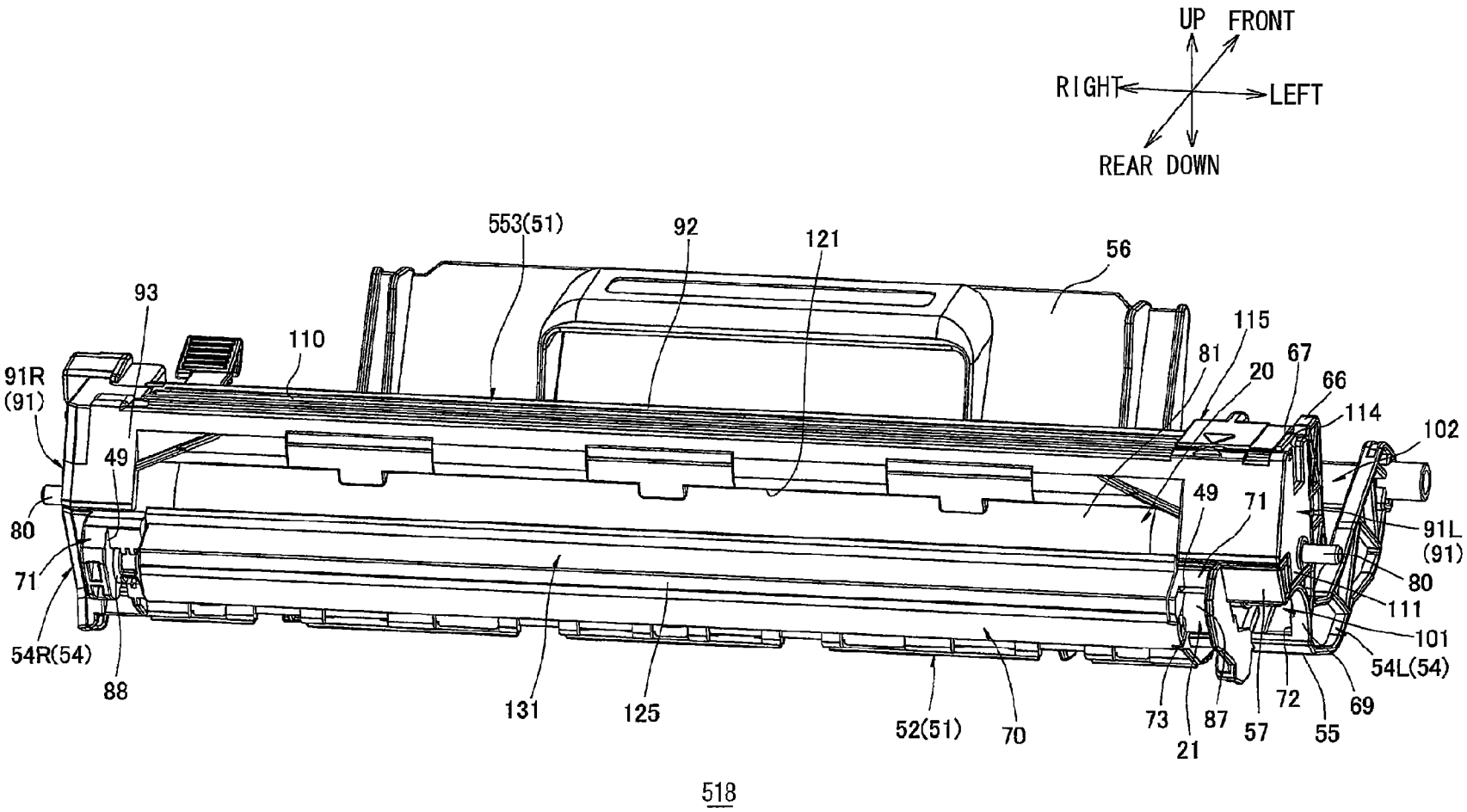
FIG. 9 is a perspective view of a drum cartridge according to a modification of the present invention.

The transfer roller 21 is elastically and slightly moved by the rotation of the photosensitive drum 20 and the pressing force of the biasing member 131, while being guided by the guide groove 73 (See FIG. 9). Specifically, the transfer roller 21 is moved alternatively toward the rear lower side (in a separating direction in which the transfer roller 21 moves away from the photosensitive drum 20) and toward the front upper side (in an approaching direction in which the transfer roller 21 approaches the photosensitive drum 20).

As a result, due to the rotation and movement (front-rear direction movement) of the transfer roller 21, the transfer roller support section 70 supporting the transfer roller 21 slightly vibrates.

As described above, the cover frame 53 has been positioned relative to the drum support section 101 of the base frame 52 as shown in FIG. 7. Meanwhile, the engagement claw 124 is loosely engaged with the engagement concave section 78, and the fitting projections 77 are loosely engaged with the fitting holes 123. Therefore, the cover frame 53 and the transfer roller support section 70 are engaged and have some play (a prescribed gap therebetween).

This configuration prevents the vibration of the transfer roller support section 70 from being transmitted to the cover frame 53, and prevents the vibration of the transfer roller support section 70 from being transmitted to the discharge opening 121. Therefore, the relative position of the discharge opening 121 with respect to the conveying path (See the imaginary line of FIG. 1) is stable.

4. Operation and Effects (1) In the drum cartridge 18, as shown in FIG. 2, the discharge opening 121 is formed only on the cover frame 53 that is a separate body from the base frame 52.

Therefore, when the transfer roller support section 70 of the base frame 52 vibrates due to the rotation of the transfer roller 21, the drum cartridge 18 can prevent the vibration from being directly transmitted to the cover frame 53, and thereby stabilizes the position of the discharge opening 121.

As a result, after passing between the photosensitive drum 20 and the transfer roller 21, the sheet S can pass through the discharge opening 121 without fail and can be prevented from contacting with the peripheral portion of the discharge opening 121.

Accordingly, with the drum cartridge 18, the distortion of the toner image that has been transferred onto the sheet S can be curbed, and a decline in image quality can be prevented.

(2) In the drum cartridge 18, as shown in FIG. 9, the transfer roller 21 can be moved forward and backward along the guide groove 73 so as to follow the rotation of the photosensitive drum 20.

Therefore, the vibration that is transmitted to the base frame 52 due to the rotation of the transfer roller 21 can be reduced.

And then, the vibration of the cover frame 53 can be more curbed, and the position of the discharge opening 121 can be more stabilized.

As a result, the distortion of the toner image that has been transferred onto the sheet S can be more curbed, and the decrease in image quality can be more curbed.

(3) In the drum cartridge 18, as shown in FIG. 4, the base frame 52 has the sheet-feeding opening 74 allowing the sheet S to pass therethrough and move toward the nip portion N between the photosensitive drum 20 and the transfer roller 21.

With this configuration, the drum cartridge 18 can easily secure the accuracy of the arrangement of the sheet-feeding opening 74 relative to the photosensitive drum 20 and the transfer roller 21.

As a result, the sheet S can surely pass through the sheet-feeding opening 74, and can be supplied to the nip portion N between the photosensitive drum 20 and the transfer roller 21.

(4) In the drum cartridge 18, as shown in FIGS. 3 and 5, after the base frame 52 and the cover frame 53 are assembled together, the transfer roller 21 inside the transfer roller support section 70 is covered and protected by the covering section 122 of the cover frame 53.

With the configuration of the drum cartridge 18, as shown in FIG. 7, the protrusion 76 is provided in the rear upper end portion of the transfer roller support section 70 so as to protrude to the inner side (front side) toward the transfer roller 21. The protrusion 76 prevents the sheet S from being caught up further.

As a result, even if the sheet S is jammed by the rotation of the transfer roller 21 after passing between the photosensitive drum 20 and the transfer roller 21, the jammed sheet S can be easily removed.

(5) In the drum cartridge 18, as shown in FIG. 7, the engagement claw 124 of the cover frame 53 is engaged into the engagement concave section 78 of the base frame 52 so as to have a small gap in the up-down direction between the engagement claw 124 and t the engagement concave section 78.

Therefore, the transfer roller support section 70 of the base frame 52 and the covering section 122 of the cover frame 53 can be engaged so as to have a small gap.

The gap formed between the engagement claw 124 and the engagement concave section 78 in the up-down-direction can prevent the vibration of the transfer roller support section 70 of the base frame 52 from being transmitted to the covering section 122 of the cover frame 53.

As a result, the vibration of the cover frame 53 can be more curbed, and the position of the discharge opening 121 can be more stabilized.

(6) In the drum cartridge 18, as shown in FIG. 7, the engagement claw 124 extends downward from the cover frame 53 to the base frame 52, and the tip portion thereof is bent forward and extends toward the passage path of the sheet S.

With this configuration, if a force is applied to the cover frame 53 in the conveying direction of the sheet S due to the sheet S hitting the cover frame 53, the tip portion (lower end portion) of the engagement claw 124 is fitted more deeply into the engagement concave section 78 of the base frame 52.

As a result, the base frame 52 and the cover frame 53 can be fitted together reliably.

(7) In the drum cartridge 18, as shown in FIG. 2, the front wall 56 is provided in the front end portion of the base frame 52. The front wall 56 and the transfer roller support section 70 are disposed so as to face each other with a gap in the front-rear direction therebetween.

If the base frame is molded by being sandwiched between the first die (upper die) and the second die (lower die) in the up-down direction, it might be difficult for the first die to depart from the molded base frame in the front-rear direction (or in the direction in which the transfer roller support section and the front wall are arranged).

Moreover, if the discharge opening is formed on the base frame in the vicinity of the transfer roller support section (especially in the vicinity of the upper side), the interference between a portion where the discharge opening is formed and the first die sometimes makes it difficult to separate the first die from the molded base frame to the upper side.

However, in the drum cartridge 18, the cover frame 53 is formed as a separate body from the base frame 52, and the discharge opening 121 is formed on the cover frame 53.

With the above-described configuration, it can prevent the portion where the discharge opening 121 is formed from interfering with the first die. Therefore, the first die can be easily separated from the base frame 52 by passing through the upper end portion of the base frame 52.

As a result, the base frame 52 can be molded in a simple and efficient way.

(8) In the printer 1, as shown in FIG. 1, the discharge opening 121 of the drum cartridge 18 is disposed so as to face the fixing unit 17 in the main casing 2. Further, the cover frame 53 of the drum cartridge 18 is made of a material whose fire retardancy (flame retardancy) is higher than that of the base frame 52.

With the configuration, the fire retardancy of the cover frame 53 can be ensured, and the discharge opening 121 can be placed near the fixing unit 17.

As a result, the sheet S that has passed through the discharge opening 121 can be carried to the fixing unit 17 certainly.

(9) In the printer 1, as shown in FIG. 1, the fixing unit 17 is disposed above the discharge opening 121 and faces the discharge opening 121. The sheet S passes between the photosensitive drum 20 and the transfer roller 21 and is conveyed and passed upward and toward the fixing unit 17.

If the sheet S hits the peripheral edge portion of the discharge opening 121 or the like when being conveyed to the fixing unit 17, an upper end portion (leading end portion) of the sheet S might get kinked significantly.

However, with the drum cartridge 18, the position of the discharge opening 121 can be stabilized, thereby preventing the sheet S from hitting the peripheral edge portion of the discharge opening 121 or the like when the sheet S is being conveyed to the fixing unit 17.

Therefore, the sheet S that has passed through the discharge opening 121 can be more reliably conveyed to the fixing unit 17.

5. Modification (1) With reference to FIGS. 9 and 10, a drum cartridge 518 according to a modification will be described. Incidentally, in FIGS. 9 and 10, the same members as those in the embodiment are represented by the same reference symbols, and will not be described again.

In the above-described embodiment, the covering section 122 is integrally provided on the cover frame 53. The covering section 122 is disposed in the lower end portion of the discharge opening 121 and covers the transfer roller support section 70.

Figure 10:
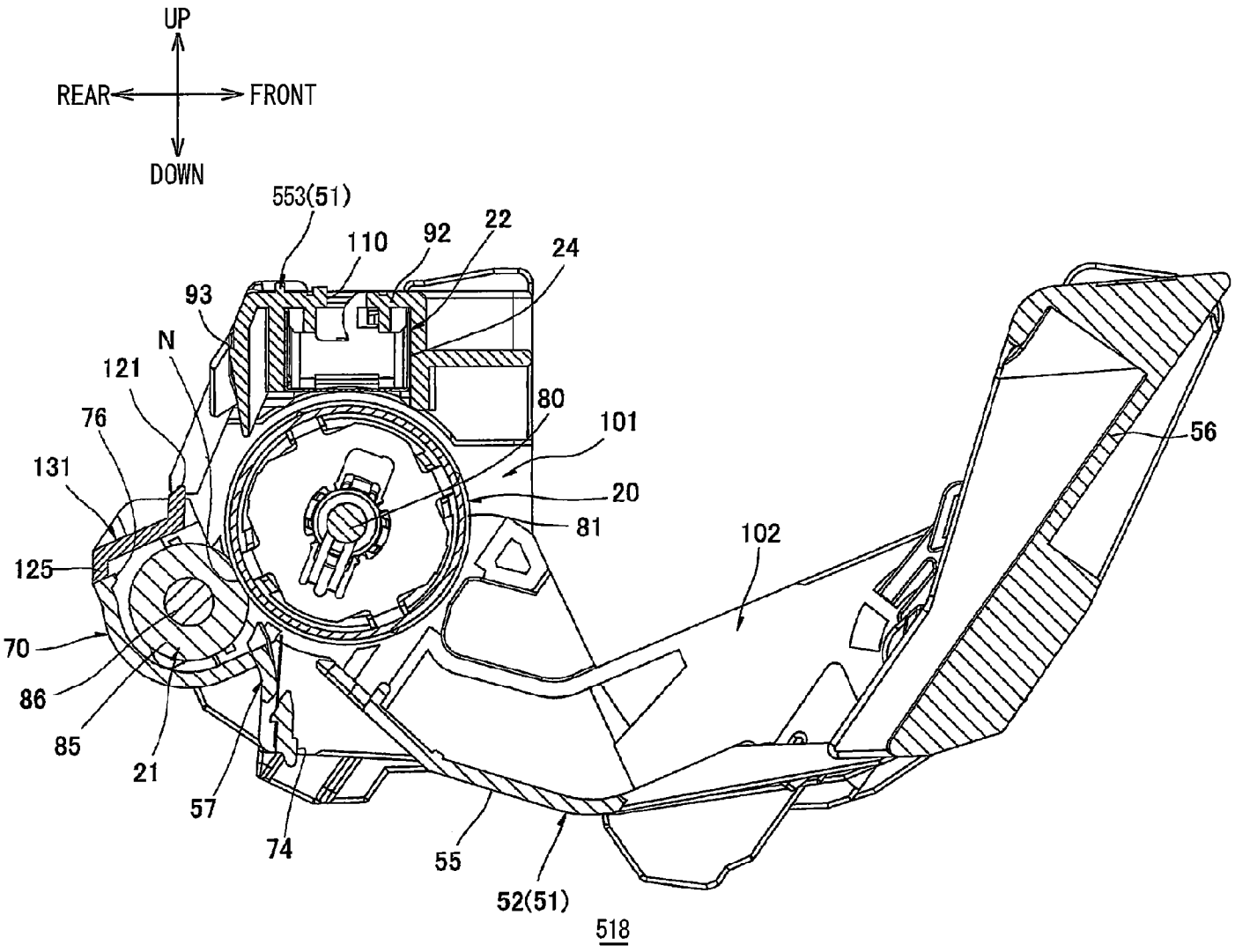
FIG. 10 is a central cross-sectional view of the drum cartridge shown in FIG. 9.

In this modification, as shown in FIGS. 9 and 10, the drum cartridge 518 includes: a cover frame 553 instead of the cover frame 53, and a covering member 131. The cover frame 553 has the configuration same as the cover frame 53 except that the covering section 122 is not provided on the cover frame 553. The covering member 131 is formed as a separate body from the cover frame 553 to cover the transfer roller support section 70. The discharge opening 121 is defined between the cover frame 553 and the covering member 131. In other words, the cover frame 553 defines at least part of the discharge opening 121.

The covering member 131 is mounted on the upper end portion of the transfer roller support section 70 so as to cover the transfer roller 21 from the upper side. The covering member 131 is formed into a flat-plate shape that is substantially rectangular in planar view and which extends in the left-right direction. The length of the covering member 131 in the left-right-direction is substantially equal to that of the length of a gap between the transfer roller shaft guide sections 71 of the transfer roller support sections 70.

This variation can also obtain the same operational advantages described above for the embodiment.

(2) Further, the printer 1 described above is an example of the image forming apparatus of the present invention, but the present invention is not limited to the embodiment described above.

The image forming apparatus of the present invention may include a monochromic printer and a color printer.

Examples of color printers include: a direct tandem color printer provided with a plurality of photosensitive members, and a recording medium conveying member; and an intermediate-transfer-type tandem color printer provided with a plurality of photosensitive members, an intermediate transfer body, and a transfer member.

In addition to the separable process cartridge 15 that allows the drum cartridge 18 and developing cartridge 19 to be detached from each other as described above, the process cartridge 15 may be an integrated unit in which the drum cartridge 18 and developing cartridge 19 are integrally provided.

It is also possible to provide the drum cartridge 18 attached to the main casing 2, while enabling only the developing cartridge 19 to be mounted in and removed from the main casing 2.

The developing cartridge 19 may also be configured of a frame possessing the developing roller 34, and a toner cartridge for accommodating toner that is detachably mountable on the frame.

Further, while the photosensitive drum 20 described above is an example of the image-carrying member, a photosensitive belt may be used as the image-carrying member.

Further, while the developing roller 34 described above is an example of a developer-carrying member, a developing sleeve, developing belt, brush roller, or other device may be used as the developer-carrying member.

Further, while the supply roller 33 described above is an example of a supply member, a device other than the supply roller 33, such as a supply sleeve, a supply belt, or a brush roller, may be used as the supply member.

Further, while the agitator 29 described above is an example of a conveying member, a device other than the agitator 29, such as an auger screw or a conveying belt, may be used as the conveying member.

Further, while the transfer roller 21 described above is an example of the transfer member, the transfer member may be configured of a contact-type transfer member including a transfer belt, a transfer brush, a transfer blade, and a film-like transfer device, or a non-contact-type transfer member including a corotron-type transfer member.

Further, while the scorotron charger 22 described above is an example of a charger, the charger may be configured of: a non-contact type device including a corotron-type charger, and a charger provided with a sawtooth discharge member; or a contact-type charger such as a charging roller.

Further, while the scanning unit 16 described above is an example of an exposing member, a device other than the scanning unit 16, such as an LED unit may be used as the exposing member.

Further, the image forming apparatus of the present invention may be configured as a multifunction device provided with an image scanner.

While the invention has been described in detail with reference to the embodiment and modifications thereof, it would be apparent to those skilled in the art that various changes and modifications may be made therein without departing from the scope of the invention.

What is claimed is:

1. A cartridge comprising:

a first frame;

an image-carrying member rotatably supported by the first frame and configured to carry a developer image thereon;

a transfer member rotatably supported by the first frame and facing the image-carrying member, the transfer member being configured to transfer the developer image from the image-carrying member to a recording medium, the image-carrying member and the transfer member defining a nip portion therebetween; and a second frame detachably attachable to the first frame, the second frame, when attached to the first frame, being disposed downstream from the nip portion in a passage direction in which the recording medium passes, the second frame defining at least part of a first opening allowing the recording medium that has passed through the nip portion to pass therethrough.

2. The cartridge as claimed in claim 1, wherein, the transfer member supported by the first frame is movable in an approaching direction in which the transfer member approaches the image-carrying member and in a separating direction in which the transfer member moves away from the image-carrying member.

3. The cartridge as claimed in claim 1, wherein the first opening is formed in the second frame.

4. The cartridge as claimed in claim 1, wherein the first frame has a second opening allowing a recording medium that is moving toward the nip portion to pass therethrough.

5. The cartridge as claimed in claim 1, wherein the first frame is provided with a support portion configured to support the transfer member, wherein the second frame is provided with a contact portion configured to contact the support portion, and wherein the support portion includes:

a receiving portion configured to receive the contact portion; and a protruding portion protruding from the receiving portion toward the transfer member.

6. The cartridge as claimed in claim 5, wherein one of the first frame and the second frame includes an engaging portion, and another of the first frame and the second frame includes an engaged portion configured to be engaged with the engaging portion, the engaging portion and the engaged portion having a prescribed gap therebetween when the engaging portion and the engaged portion are engaged.

7. The cartridge as claimed in claim 6, wherein the engaging portion extends from the second frame to the first frame in the passage direction and has a tip portion, the tip portion being bent toward a passage path along which a recording medium passes.

8. The cartridge as claimed in claim 1, wherein the first frame includes:

a first supporting portion configured to support the image-carrying member;

a second supporting portion configured to support the transfer member; and a mounted portion on which a developing unit for supplying developer to the image-carrying member is mounted, the mounted portion being positioned opposite to the second supporting portion with respect to the first supporting portion, the mounted portion having a wall part that faces and is separated from the second supporting portion in an arranged direction, the second supporting portion, the first supporting portion, and the mounted portion are arranged in the arranged direction.

9. An image forming apparatus comprising:

a cartridge comprising:

a first frame;

an image-carrying member rotatably supported by the first frame and configured to carry a developer image thereon;

a transfer member rotatably supported by the first frame and facing the image-carrying member, the transfer member being configured to transfer the developer image from the image-carrying member to a recording medium, the image-carrying member and the transfer member defining a nip portion therebetween; and a second frame detachably attachable to the first frame, wherein the second frame, when attached to the first frame, is disposed downstream from the nip portion in a passage direction in which a recording medium passes, the second frame defining at least part of a first opening allowing a recording medium that has passed through the nip portion to pass therethrough, the second frame being made of a material having a fire retardancy higher than a fire retardancy of the first frame;

a main body on which the cartridge is mounted; and a fixing device disposed within the main body and opposing the first opening, the fixing device being configured to thermally fix the developer image onto a recording medium that has been passed through the first opening.

10. The image forming apparatus as claimed in claim 9, wherein the fixing device is disposed above the first opening, and a recording medium passes upward between the image-carrying member and the transfer member.

11. A cartridge comprising:

a first frame;

an image-carrying member rotatably supported by the first frame and configured to carry a developer image thereon;

a transfer member rotatably supported by the first frame and facing the image-carrying member, the transfer member being configured to transfer the developer image from the image-carrying member to a recording medium, the image-carrying member and the transfer member defining a nip portion therebetween; and a second frame detachably attached to the first frame and disposed downstream from the nip portion in a passage direction in which the recording medium passes, the second frame defining at least part of a first opening allowing the recording medium that has passed through the nip portion to pass therethrough, wherein the first frame is provided with a support portion configured to support the transfer member, wherein the second frame is provided with a contact portion configured to contact the support portion, wherein the support portion includes:

a receiving portion configured to receive the contact portion; and a protruding portion protruding from the receiving portion toward the transfer member, and wherein one of the first frame and the second frame includes an engaging portion, and another of the first frame and the second frame includes an engaged portion configured to be engaged with the engaging portion, the engaging portion and the engaged portion having a prescribed gap therebetween when the engaging portion and the engaged portion are engaged.

12. The cartridge as claimed in claim 11, wherein the engaging portion extends from the second frame to the first frame in the passage direction and has a tip portion, the tip portion being bent toward a passage path along which a recording medium passes.

13. The cartridge as claimed in claim 12, wherein the engaged portion includes an engagement concave section, and wherein the engaging portion includes an engagement claw fitted into the engagement concave section.

14. The cartridge as claimed in claim 11, wherein the engaged portion includes an engagement concave section, and wherein the engaging portion includes an engagement claw fitted into the engagement concave section.

15. A cartridge comprising:

a first frame;

an image-carrying member rotatably supported by the first frame and configured to carry a developer image thereon;

a transfer member rotatably supported by the first frame and facing the image-carrying member, the transfer member being configured to transfer the developer image from the image-carrying member to a recording medium, the image-carrying member and the transfer member defining a nip portion therebetween; and a second frame attached to the first frame and disposed downstream from the nip portion in a passage direction in which the recording medium passes, the second frame defining at least part of a first opening allowing the recording medium that has passed through the nip portion to pass therethrough, wherein the first frame includes:

a first supporting portion configured to support the image-carrying member;

a second supporting portion configured to support the transfer member; and a mounted portion on which a developing unit for supplying developer to the image-carrying member is mounted, the mounted portion being positioned opposite to the second supporting portion with respect to the first supporting portion, the mounted portion having a wall part that faces and is separated from the second supporting portion in an arranged direction, the second supporting portion, the first supporting portion, and the mounted portion are arranged in the arranged direction.

* * * * *